US010182617B2

(12) United States Patent
Craig

(10) Patent No.: US 10,182,617 B2
(45) Date of Patent: Jan. 22, 2019

(54) FOOTWEAR UPPER INCORPORATING A KNITTED COMPONENT WITH COLLAR AND THROAT PORTIONS

(71) Applicant: NIKE, Inc., Beaverton, OR (US)

(72) Inventor: Kenneth T. Craig, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 330 days.

(21) Appl. No.: 13/681,842

(22) Filed: Nov. 20, 2012

(65) Prior Publication Data

US 2014/0137433 A1 May 22, 2014

(51) Int. Cl.
*A43B 23/00* (2006.01)
*A43B 23/02* (2006.01)
(Continued)

(52) U.S. Cl.
CPC ..... *A43B 23/0205* (2013.01); *A43B 1/04* (2013.01); *A43B 5/06* (2013.01); *A43B 23/024* (2013.01); *A43B 23/025* (2013.01); *A43B 23/0235* (2013.01); *A43B 23/0275* (2013.01); *A43B 23/0295* (2013.01); *A43C 1/04* (2013.01); *D04B 1/108* (2013.01); *D04B 1/22* (2013.01); *D10B 2403/023* (2013.01); *D10B 2501/043* (2013.01)

(58) Field of Classification Search
CPC ..... A43B 1/04; A43B 1/009; A43B 23/0245; A43B 23/0235; A43B 23/0295; A43B 23/02; A43B 23/00; A43B 23/025; A43B 23/0275; A43B 23/024; A43B 23/0205; A43B 5/06; A43B 23/06; D04B 1/22; D04B 1/225; D04B 1/26
USPC ..... 36/88, 10, 45, 47, 55; 2/239; 66/169 R, 66/185, 186, 190
See application file for complete search history.

(56) References Cited

U.S. PATENT DOCUMENTS 2,147,197 A 2/1939 Glidden
2,314,098 A 3/1943 McDonald
(Continued)

FOREIGN PATENT DOCUMENTS

CN 201536681 U 8/2010
CN 103556384 A 2/2014
(Continued)

OTHER PUBLICATIONS

Declaration of Dr. Edward C. Frederick from the US Patent and Trademark Office Inter Partes Review of U.S. Pat. No. 7,347,011 (178 pp).
(Continued)

*Primary Examiner* — Katharine Gracz
(74) *Attorney, Agent, or Firm* — Brinks Gilson & Lione

(57) ABSTRACT

An article of footwear may include an upper having a knitted component formed of unitary knit construction. The knitted component includes a collar portion and a throat portion. The collar portion has a cylindrical configuration and the throat portion extends outward from the collar portion. In some configurations, the collar portion and the throat portion form (a) a first area of an exterior surface of the upper and (b) a first area of an interior surface of the upper. The upper may also include a cover component secured to the knitted component and forming (a) a second area of the exterior surface of the upper and (b) a second area of the interior surface of the upper.

21 Claims, 23 Drawing Sheets

(51) Int. Cl.

| | |
|---|---|
| ***A43B 1/04*** | (2006.01) |
| ***A43B 5/06*** | (2006.01) |
| ***A43C 1/04*** | (2006.01) |
| ***D04B 1/10*** | (2006.01) |
| ***D04B 1/22*** | (2006.01) |

(56) References Cited

U.S. PATENT DOCUMENTS

| | | | | |
|---|---|---|---|---|
| 2,343,390 | A | 3/1944 | Ushakoff | |
| 2,440,393 | A | 4/1948 | Clark | |
| 2,569,764 | A | 10/1951 | Jonas | |
| 2,586,045 | A * | 2/1952 | Hoza | 36/9 R |
| 2,608,078 | A | 8/1952 | Anderson | |
| 2,641,004 | A | 6/1953 | Whiting et al. | |
| 2,675,631 | A * | 4/1954 | Doughty | 36/9 R |
| 2,770,055 | A | 11/1956 | Hayden | |
| 3,583,081 | A | 6/1971 | Hayashi | |
| 4,447,967 | A | 5/1984 | Mortara | |
| 4,750,339 | A | 6/1988 | Simpson et al. | |
| 4,756,098 | A | 7/1988 | Boggia | |
| 4,785,558 | A | 11/1988 | Shiomura | |
| 4,813,158 | A | 3/1989 | Brown | |
| 4,967,494 | A * | 11/1990 | Johnson | 36/9 R |
| 5,345,638 | A | 9/1994 | Nishida | |
| 5,353,524 | A | 10/1994 | Brier | |
| 6,029,376 | A * | 2/2000 | Cass | A43C 1/04 36/50.1 |
| 6,227,010 | B1 | 5/2001 | Roell | |
| 6,333,105 | B1 | 12/2001 | Tanaka et al. | |
| 6,986,269 | B2 | 1/2006 | Dua | |
| 8,448,474 | B1 | 5/2013 | Tatler et al. | |
| 2002/0148258 | A1 | 10/2002 | Cole et al. | |
| 2005/0115284 | A1* | 6/2005 | Dua | 66/178 R |
| 2006/0010931 | A1* | 1/2006 | Lynch et al. | 66/185 |
| 2007/0294920 | A1 | 12/2007 | Baychar | |
| 2008/0110048 | A1 | 5/2008 | Dua et al. | |
| 2009/0158621 | A1 | 6/2009 | Yamamoto | |
| 2010/0154256 | A1 | 6/2010 | Dua | |
| 2011/0078921 | A1* | 4/2011 | Greene et al. | 36/47 |
| 2012/0240429 | A1 | 9/2012 | Sokolowski et al. | |
| 2012/0255201 | A1 | 10/2012 | Little | |
| 2013/0160323 | A1 | 6/2013 | Hsiao | |
| 2013/0269209 | A1 | 10/2013 | Lang et al. | |
| 2013/0269212 | A1 | 10/2013 | Little | |
| 2014/0150292 | A1 | 6/2014 | Podhajny et al. | |
| 2015/0075031 | A1 | 3/2015 | Podhajny et al. | |

FOREIGN PATENT DOCUMENTS

| | | |
|---|---|---|
| DE | 475363 | 4/1929 |
| DE | 1084173 | 6/1960 |
| DE | 19738433 | 4/1998 |
| DE | 19728848 | 1/1999 |
| EP | 0448714 | 10/1991 |
| EP | 0728860 | 8/1996 |
| EP | 0758693 | 2/1997 |
| EP | 1233091 | 8/2002 |
| EP | 2805638 | 11/2014 |
| FR | 2171172 | 9/1973 |
| GB | 12787 | 6/1904 |
| GB | 538865 | 8/1941 |
| GB | 782562 | 9/1957 |
| GB | 1603487 | 11/1981 |
| JP | S35-9239 B | 5/1960 |
| JP | S53-90679 U | 7/1978 |
| JP | H06113905 | 4/1994 |
| JP | H07-3502 | 1/1995 |
| JP | H08109553 | 4/1996 |
| JP | H11302943 | 11/1999 |
| JP | 3739780 B1 | 1/2006 |
| JP | 2012-512698 | 6/2012 |
| NL | 7304678 | 10/1974 |
| TW | I228158 | 2/2005 |
| WO | 9003744 | 4/1990 |
| WO | 0032861 | 6/2000 |
| WO | 0231247 | 4/2002 |
| WO | WO 2010080182 A1 | 7/2010 |
| WO | WO 2013/126313 A2 | 8/2013 |

OTHER PUBLICATIONS

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

Letter from Bruce Huffa dated Dec. 23, 2013 (71 Pages).

International Search Report and Written Opinion dated Mar. 27, 2014 in International Application No. PCT/US2013/070651.

Chinese Office Action dated Sep. 25, 2015 with partial English translation.

Korean Office Action with partial informal brief summary dated Jan. 21, 2016.

International Preliminary Report on Patentability (including Written Opinion of the ISA) dated Jun. 4, 2015 in International Application No. PCT/US2013/070651.

Taiwanese Office Action dated May 27, 2015 in Taiwanese Patent Application No. 102142337.

Chinese Office Action dated Sep. 25, 2015.

Taiwan Office Action dated Sep. 21, 2015.

European Office Action dated Jun. 30, 2015.

International Search Report and Written Opinion for International Application No. PCT/US2015/015340, dated Apr. 28, 2015 (10 pages).

International Search Report and Written Opinion for International Application No. PCT/US2015/015343, dated Jun. 16, 2015 (11 pages).

International Search Report and Written Opinion for International Application No. PCT/US2015/015346, dated Apr. 22, 2015 (10 pages).

International Search Report and Written Opinion for International Application No. PCT/US2016/026345, dated Oct. 4, 2016 (20 pages).

Office Action for Taiwanese Application No. 105111914, dated Dec. 26, 2016 (19 pages).

Office Action for Japanese Application No. 2015-543105, dated Jan. 19, 2017 (7 pages).

Examination Report and Written Opinion for EP Application No. 13814673.3 dated May 4, 2017, 13 pages.

Office Action and English translation for Chinese Application No. 201380036449.7 dated May 3, 2017, 12 pages.

Office Action and English translation for Japanese Application No. 2015-543105 dated Jun. 8, 2017, 9 pages.

Notice of Allowance and English translation for Korean Application No. 10-2014-7036252 dated Jul. 28, 2016, 6 pages.

International Search Report and Written Opinion for PCT Application No. PCT/US2013/070651 dated Mar. 27, 2014, 13 pages.

International Preliminary Report on Patentability for PCT Application No. PCT/US2013/070651 dated May 26, 2015, 8 pages.

Examination Report for Sri Lanka Application No. 18041, dated Aug. 28, 2017, 1 page.

Examination Report for EP Application No. 13814673.3 dated Jun. 26, 2018, 7 pages.

* cited by examiner

FOOTWEAR UPPER INCORPORATING A KNITTED COMPONENT WITH COLLAR AND THROAT PORTIONS

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

SUMMARY

An article of footwear is disclosed below as having an upper and a sole structure secured to the upper. A knitted component of the upper includes a collar portion and a throat portion. The collar portion has a cylindrical configuration defining an ankle opening. The throat portion extends outward from the collar portion and through at least a portion of a length of a throat area of the upper. The collar portion and the throat portion form (a) a first area of an exterior surface of the upper and (b) a first area of an interior surface of the upper. A cover component of the upper is secured to the knitted component and extends between the knitted component and the sole structure. The cover component forms (a) a second area of the exterior surface of the upper and (b) a second area of the interior surface of the upper.

In another aspect, a knitted component for an article of footwear is disclosed below. The knitted component includes a collar portion, a throat portion, a first knit layer, and a second knit layer. The collar portion has a cylindrical configuration. The throat portion extends outward from the collar portion. The first knit layer forms a first surface of the collar portion and the throat portion. The second knit layer is located adjacent to the first knit layer and forms an opposite second surface of the collar portion and the throat portion.

A method for manufacturing an article of footwear is also disclosed below. The method includes utilizing a circular knitting process to form a knitted component by (a) knitting two substantially coextensive layers and (b) joining peripheral areas of the layers to each other. The method also includes incorporating the knitted component into an upper of the article of footwear, with (a) the knitted component forming a collar of the upper and (b) the knitted component extending through a majority of a length of a throat area of the upper.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
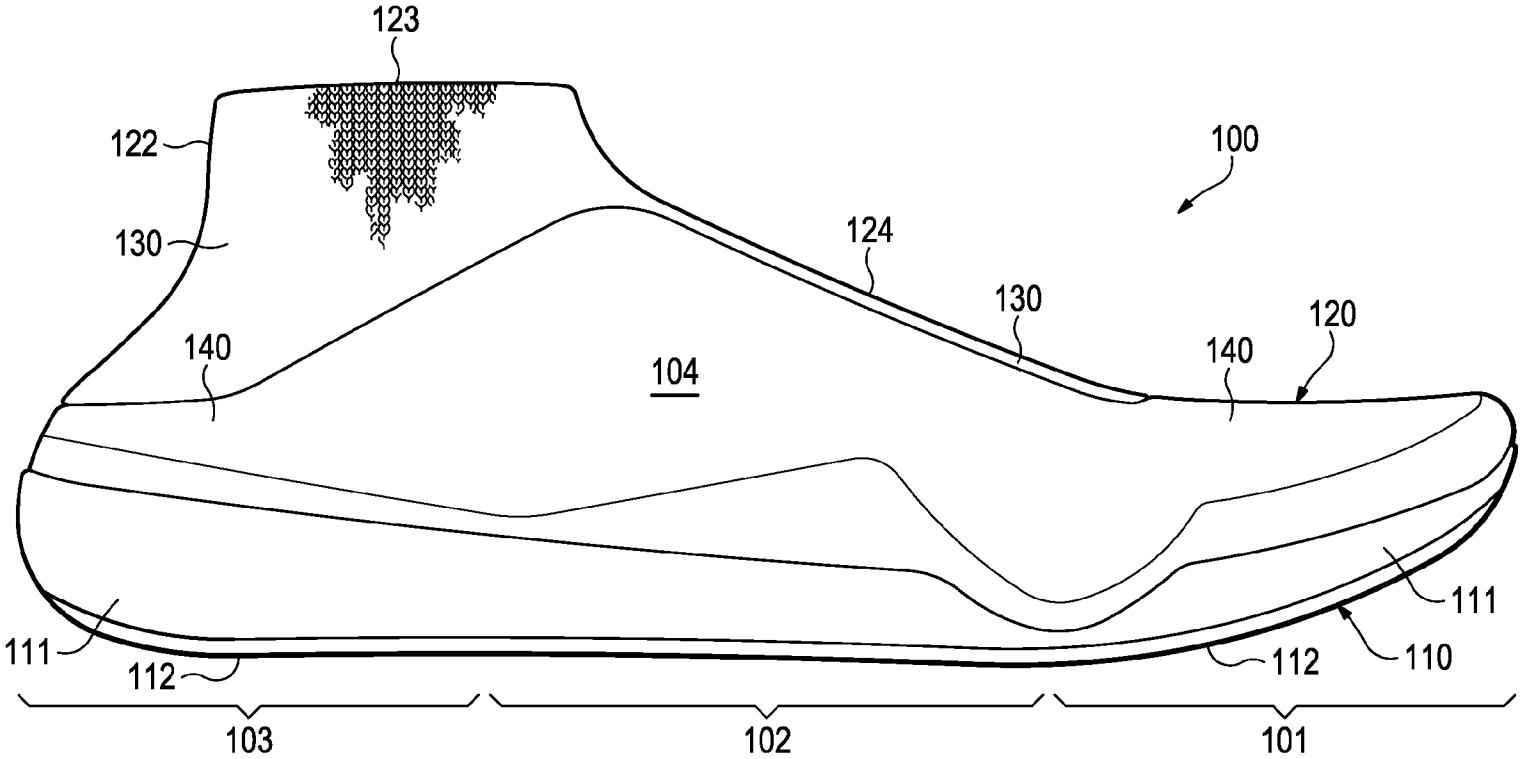
FIG. 1 is a lateral side elevational view of an article of footwear.
Figure 2:
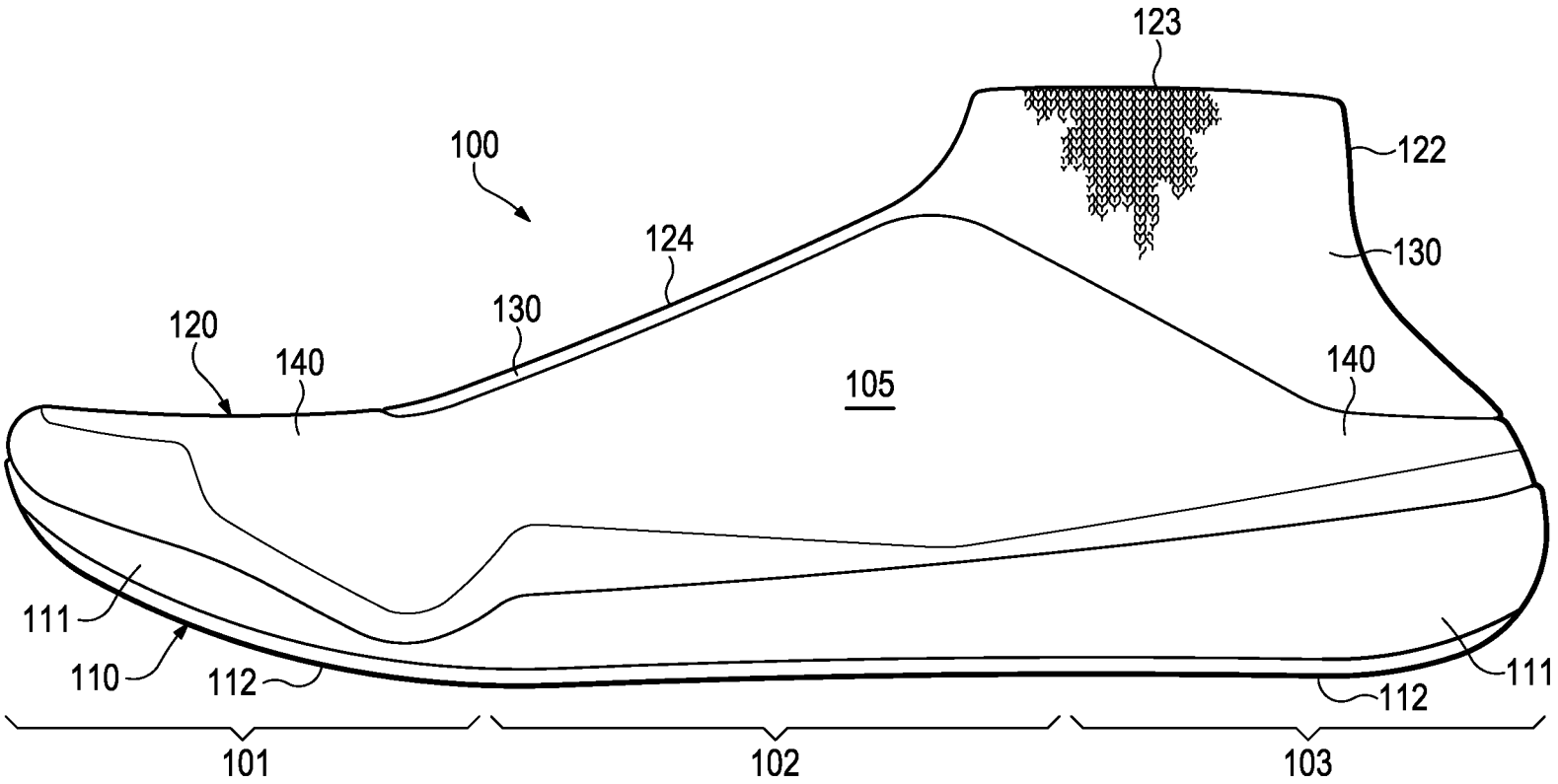
FIG. 2 is a medial side elevational view of the article of footwear.
Figure 3:
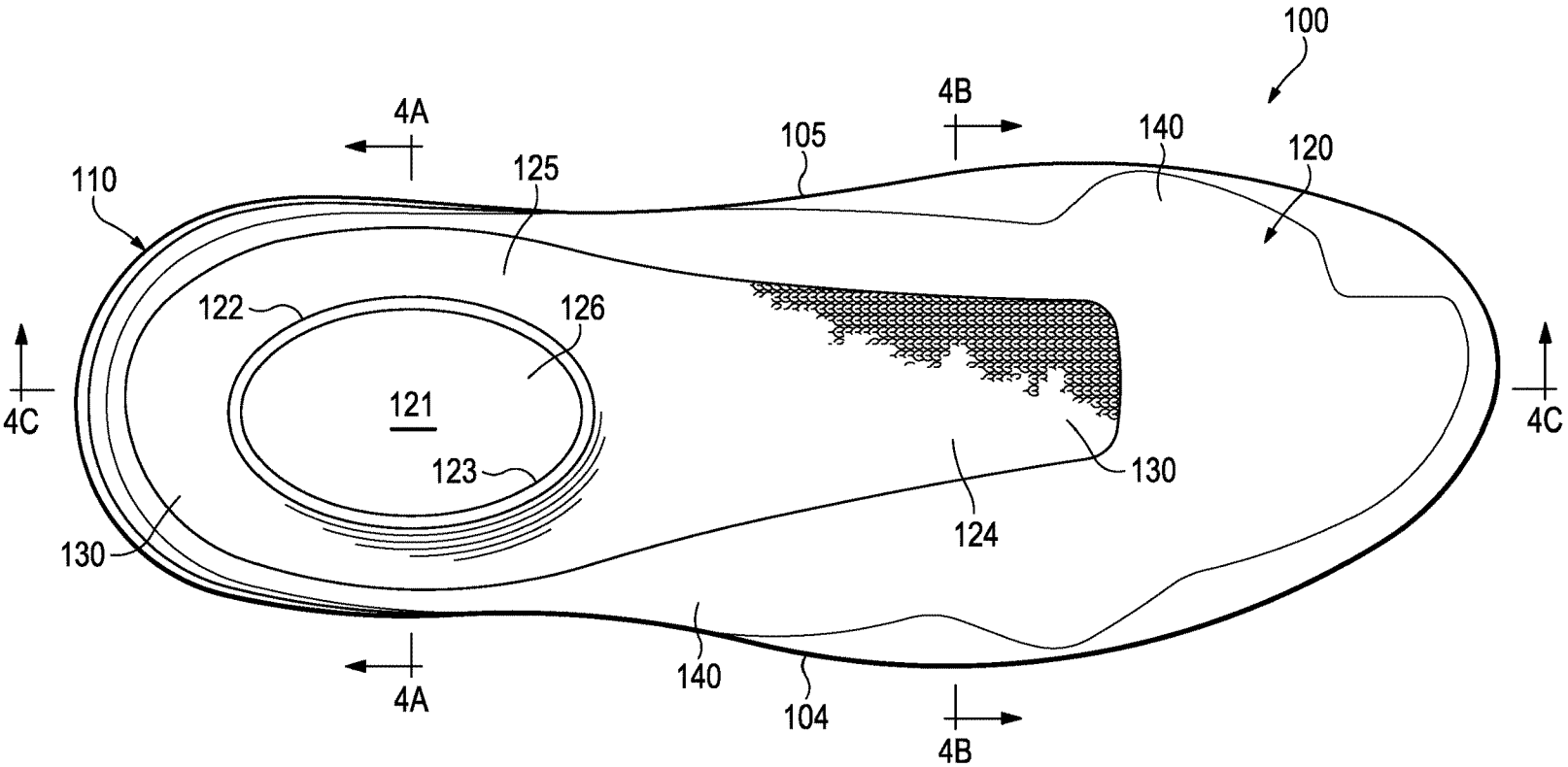
FIG. 3 is a top plan view of the article of footwear.
Figure 4A:
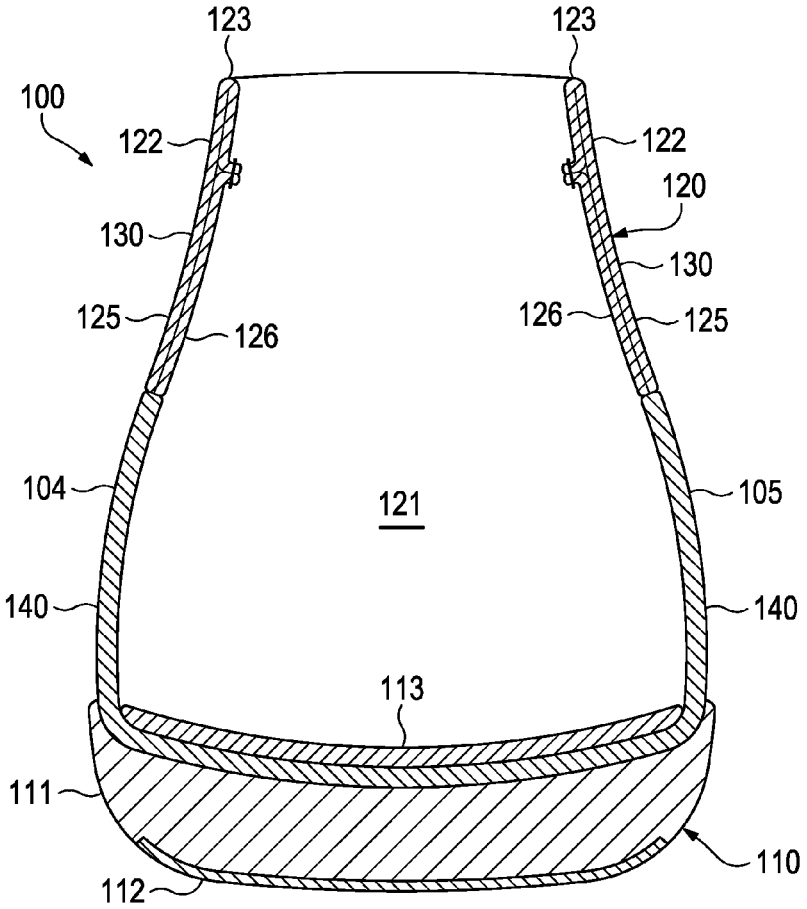
FIGS. 4A-4C are cross-sectional views of the article of footwear, as defined by section lines 4A-4C in FIG. 3.
Figure 4B:
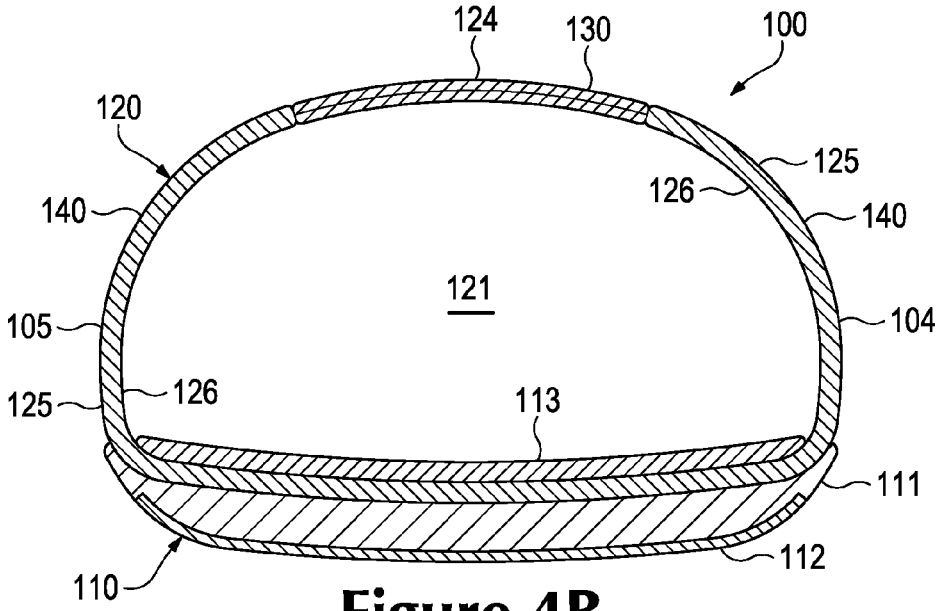
Figure 4C:
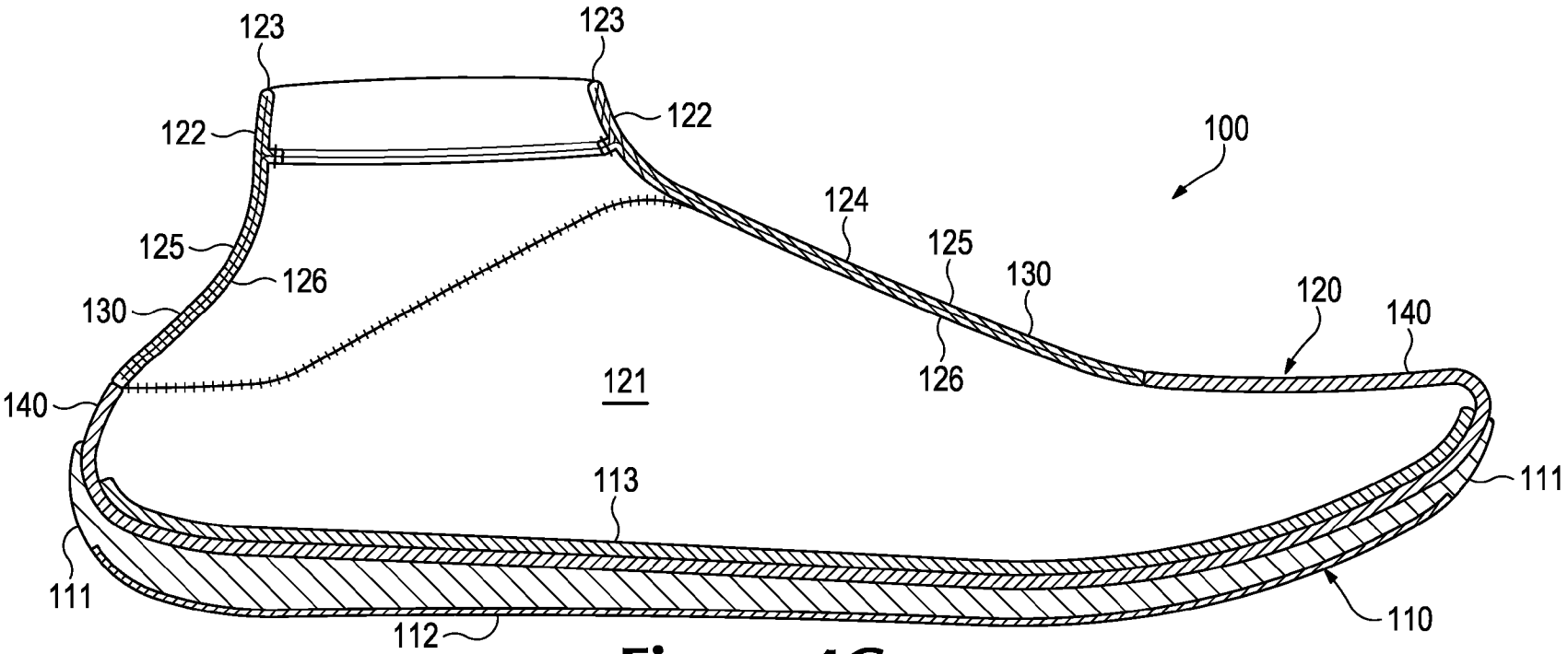

The following discussion and accompanying figures disclose a variety of concepts relating to knitted components and the manufacture of knitted components. Although the knitted components are disclosed with reference to articles of footwear having configurations that are suitable for running and basketball, concepts associated with the knitted components may be applied to a wide range of athletic footwear styles, including baseball shoes, football shoes, golf shoes, hiking shoes and boots, ski and snowboarding boots, soccer shoes, tennis shoes, training shoes, and walking shoes, for example. Concepts associated with the knitted components may also be utilized with footwear styles that are generally considered to be non-athletic, including dress shoes, loafers, sandals, and work boots. Accordingly, a variety of footwear styles and configurations may incorporate concepts discussed herein.

General Footwear Configuration

An article of footwear 100 is depicted in FIGS. 1-5 as including a sole structure 110 and an upper 120. Whereas sole structure 110 is located under and supports a foot of a wearer, upper 120 provides a comfortable and secure covering for the foot. As such, the foot may be located within upper 120 to effectively secure the foot within footwear 100 or otherwise unite the foot and footwear 100. Moreover, sole structure 110 is secured to a lower area of upper 120 and extends between the foot and the ground to attenuate ground reaction forces (i.e., cushion the foot), provide traction, enhance stability, and influence the motions of the foot, for example.

For reference purposes, footwear 100 may be divided into three general regions: a forefoot region 101, a midfoot region 102, and a heel region 103. Forefoot region 101 generally includes portions of footwear 100 corresponding with toes of the foot and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of regions 101-103 and correspond with opposite sides of footwear 100. More particularly, lateral side 104 corresponds with an outside area of the foot (i.e. the surface that faces away from the other foot), and medial side 105 corresponds with an inside area of the foot (i.e., the surface that faces toward the other foot). Regions 101-103 and sides 104-105 are not intended to demarcate precise areas of footwear 100. Rather, regions 101-103 and sides 104-105 are intended to represent general areas of footwear 100 to aid in the following discussion. In addition to footwear 100, regions 101-103 and sides 104-105 may also be applied to sole structure 110, upper 120, and individual elements thereof.

The primary elements of sole structure 110 are a midsole 111, an outsole 112, and a sockliner 113. Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 111 may incorporate plates, moderators, fluid-filled chambers, lasting elements, or motion control members that further attenuate forces, enhance stability, or influence the motions of the foot, or midsole 21 may be primarily formed from a fluid-filled chamber. Outsole 112 is secured to a lower surface of midsole 111 and may be formed from a wear-resistant rubber material that is textured to impart traction. Sockliner 113 is located within upper 120 and is positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be utilized. Accordingly, the features of sole structure 110 or any sole structure utilized with upper 120 may vary considerably.

Upper 120 defines a void 121 within footwear 100 for receiving and securing a foot relative to sole structure 110. Void 121 is shaped to accommodate the foot. When the foot is located within void 121, therefore, upper 120 extends along a lateral side of the foot, along a medial side of the foot, over the foot, around the heel, and under the foot. A collar 122 is located in at least heel region 103 and forms an ankle opening 123 that provides the foot with access to void 121. When the foot is located within void 121, collar 122 and ankle opening 123 extend around or otherwise encircle the ankle. In further configurations, upper 120 may include additional elements, such as a lacing system that assists with tightening upper 120 around the foot and loosening portions of upper 120 to allow entry and removal of the foot from void 121. Further configurations of upper 120 may also include one or more of (a) a heel counter in heel region 103 for enhancing stability, (b) a toe guard in forefoot region 101 that is formed of a wear-resistant material, and (c) logos, trademarks, and placards with care instructions and material information. Accordingly, upper 120 may incorporate various features and elements, in addition to the features and elements discussed herein and shown in the figures.

Figure 5:
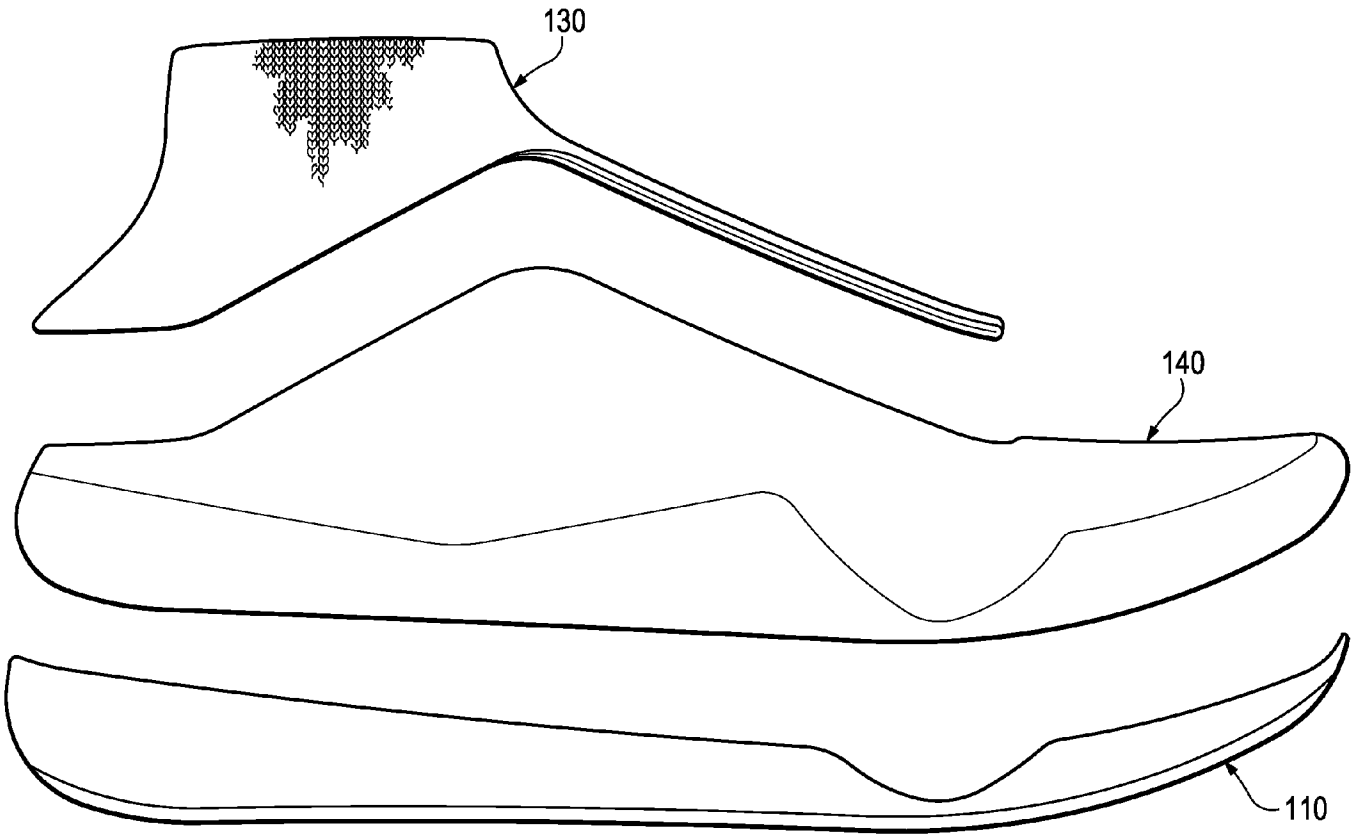
FIG. 5 is an exploded lateral side elevational view of the article of footwear.
Figure 6:
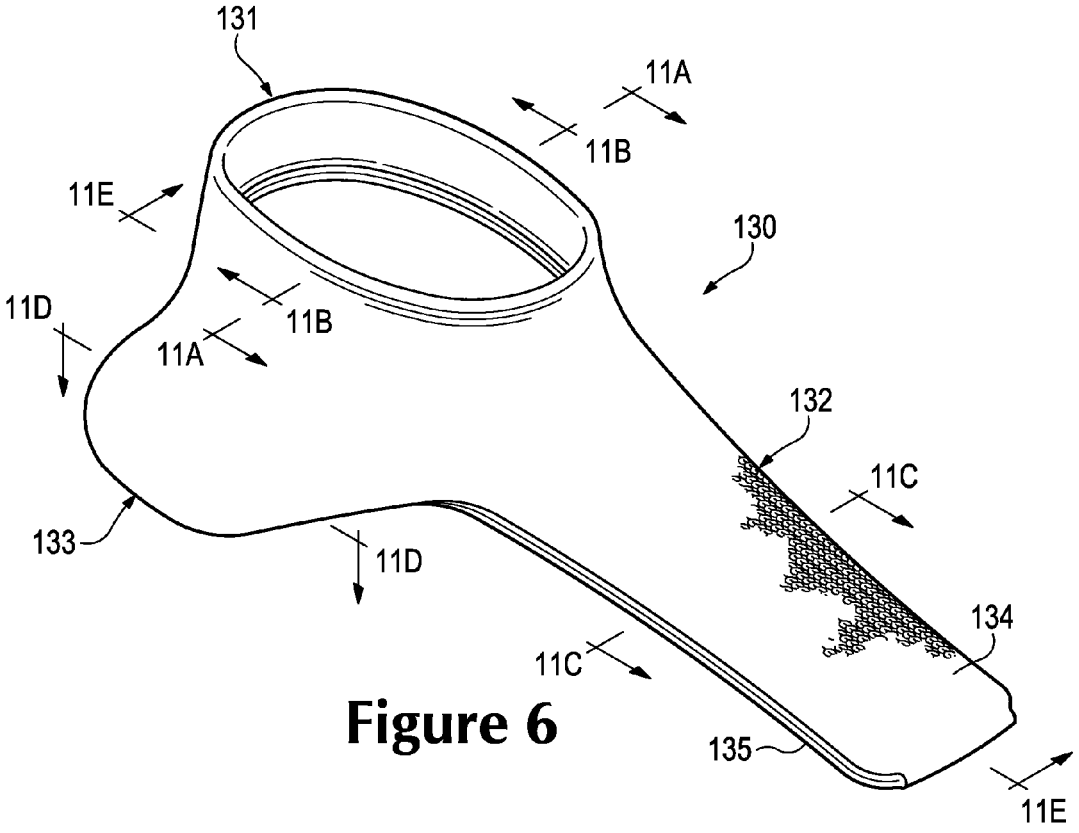
FIG. 6 is a perspective view of a knitted component that forms a portion of an upper of the article of footwear.
Figure 7:
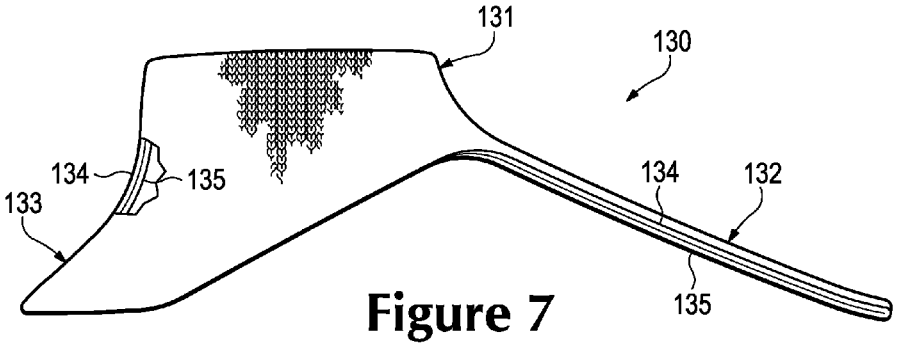
FIG. 7 is a lateral side elevational view of the knitted component.
Figure 8:
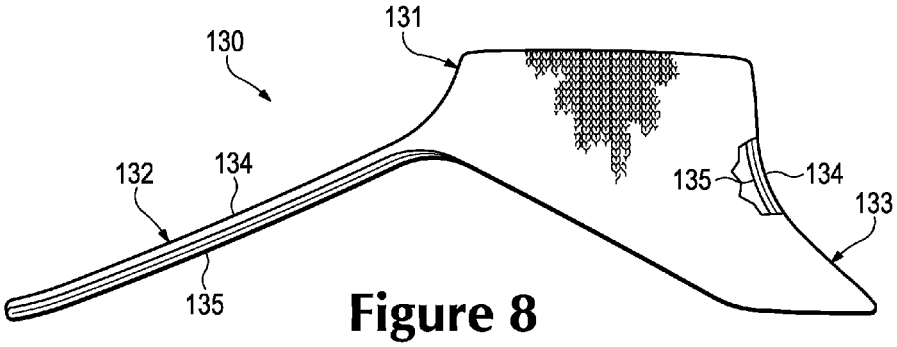
FIG. 8 is a medial side elevational view of the knitted component.
Figure 9:
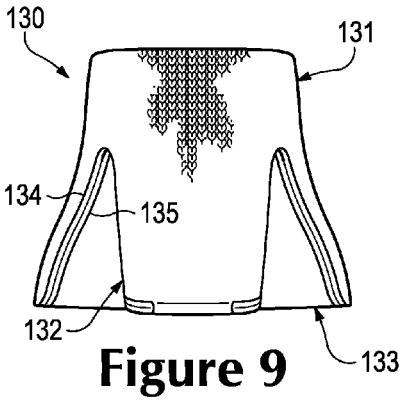
FIG. 9 is a front elevational view of the knitted component.
Figure 10:
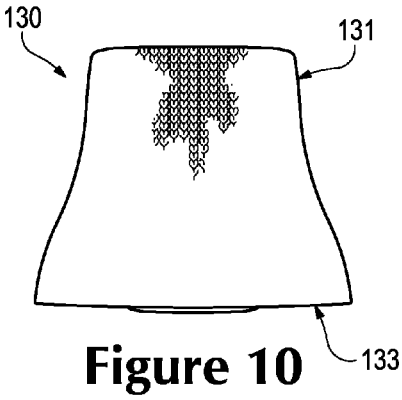
FIG. 10 is a rear elevational view of the knitted component.
Figure 11A:
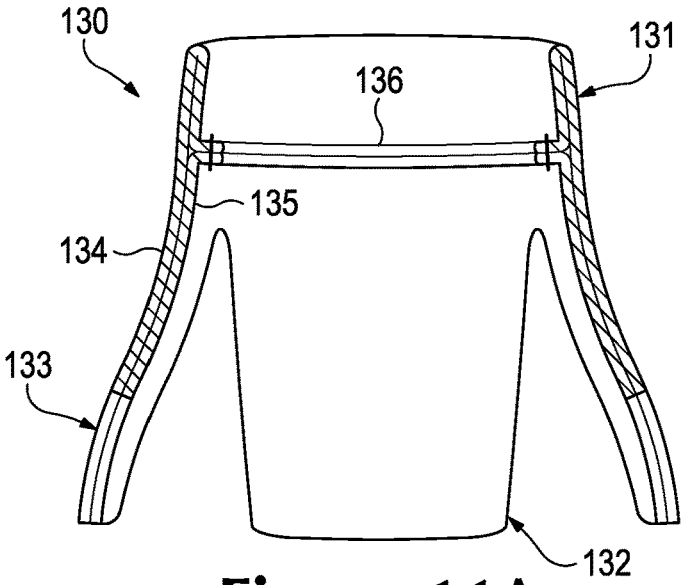
FIGS. 11A-11E are cross-sectional views of the knitted component, as defined by section lines 11A-11E in FIG. 6.
Figure 11B:
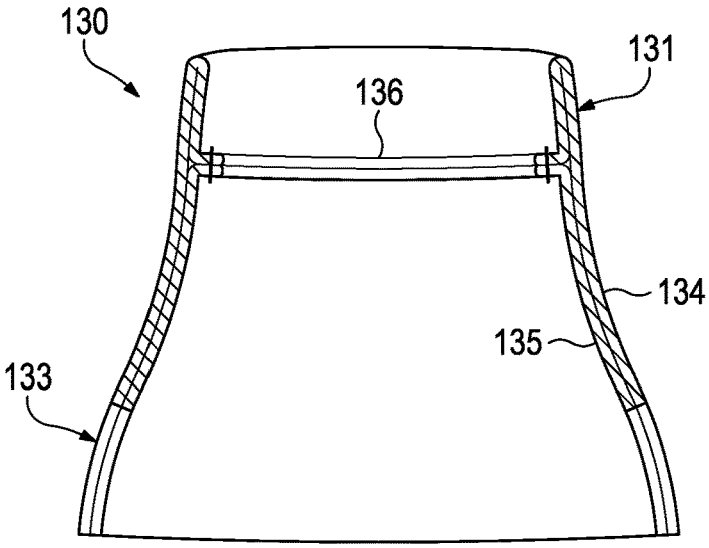
Figure 11C:
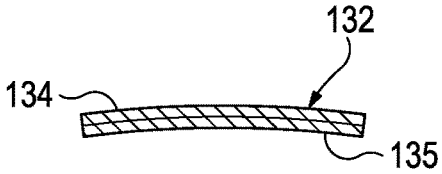
Figure 11E:
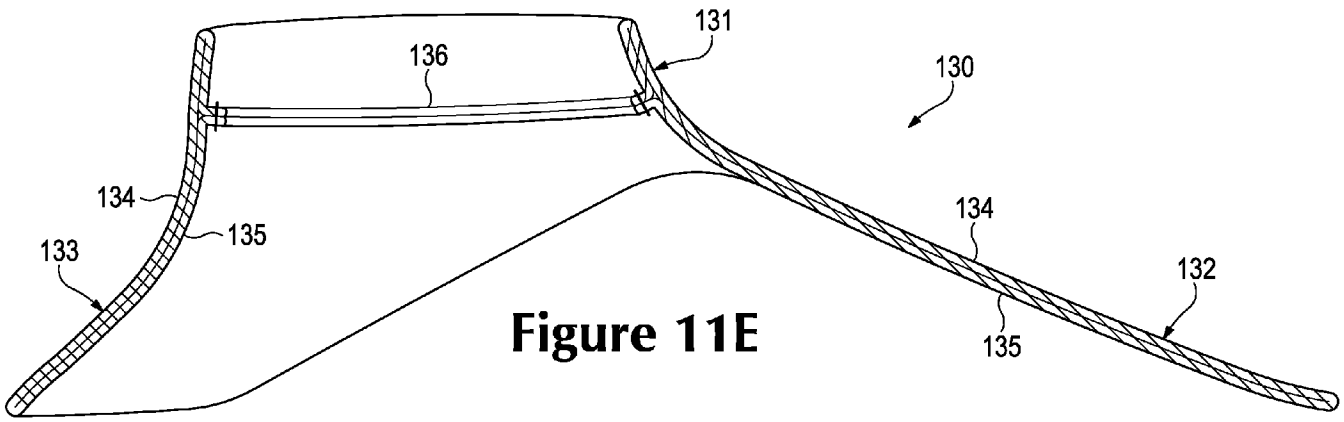
Figure 11D:
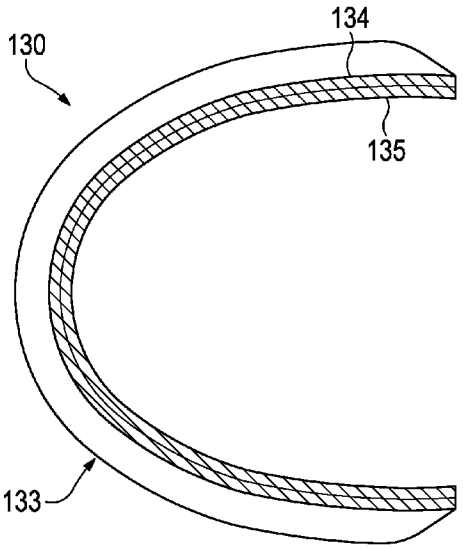

A majority of upper 120 is formed from a knitted component 130 and a cover component 140, which are depicted separately in FIG. 5. Knitted component 130 has a knitted structure and is formed of unitary knit construction (i.e., as a one-piece element) through a knitting process. When incorporated into upper 120, knitted component 130 extends through heel region 103 to form collar 122 and ankle opening 123. Knitted component 130 also extends into a throat area 124 of upper 120, which is primarily located in midfoot region 102 and corresponds with an instep region or upper surface of the foot. Cover component 140 is secured to knitted component 130 (e.g., through stitching, adhesive bonding, thermal bonding) and extends through each of regions 101-103 and between knitted component 130 and sole structure 110. That is, a portion of cover component 140 may extend between throat area 124 and an area where upper 120 is secured to sole structure 110. Although the structure of cover component 140 may vary significantly, cover component 140 may be formed from multiple material elements (e.g., textiles, polymer foam, polymer sheets, leather, synthetic leather) that are joined through stitching or bonding, for example. Moreover, cover component 140 may have a layered structure that includes multiple overlapping material elements.

Upper 120 includes an exterior surface 125 and an opposite interior surface 126. Whereas exterior surface 125 forms a portion of an outer surface of footwear 100, interior surface 126 defines a portion of void 121. As such, a foot located within void 121 (or a sock covering the foot) will contact portions of interior surface 126. Surfaces 125 and 126 are cooperatively formed by each of knitted component 130 and cover component 140. More particularly, knitted component 130 forms a first area of exterior surface 125 and cover component 140 forms a second area of exterior surface 125, and knitted component 130 forms a first area of interior surface 126 and cover component 140 forms a second area of interior surface 126. Although the proportions may vary significantly, each of components 130 and 140 may form more than thirty percent of each of surfaces 125 and 126. Accordingly, knitted component 130 and cover component 140 each form separate portions of exterior surface 125 and interior surface 126.

Advantages of knitted component 130 include stretch and recovery properties, as well as enhanced fit and comfort. When locating the foot within void 121, collar 122 may stretch to permit the foot to enter void 121 through ankle opening 123. As the foot progresses into upper 120, portions of knitted component 130 located in throat area 124 may also stretch to permit the foot to fully enter void 121. In addition to stretching, knitted component may recover or contract to secure the foot within upper 120. More particularly, collar 122 may recover to securely extend around the ankle, and the portion of knitted component 130 in throat area 124 may recover to draw cover component 140 against the foot, thereby tightening upper 120 around the foot. Various features of knitted component 130, including materials and knit structure, may be utilized to impart specific stretch and recovery properties to knitted component 130. That is, the degree of stretch and recovery may be engineered into knitted component 130. As a result, knitted component 130 may be designed to extend around the ankle and tighten upper 120 around the foot in a manner that enhances the overall fit of footwear 100. Moreover, knitted component 130 lays against the foot and provides a compliant aspect to upper 120 that enhances the overall comfort of footwear 100.

Knitted Component Configuration

Knitted component 130 is depicted individually and separate from a remainder of footwear 100 in FIGS. 6-11E. Although a knitting process for manufacturing knitted component 130 will be discussed in greater detail below, knitted component 130 is formed from at least one yarn that is manipulated (e.g., with a knitting machine) to form a plurality of intermeshed loops that define a variety of courses and wales. That is, knitted component 130 has the structure of a knit textile. Moreover, knitted component 130 is formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. Although portions of knitted component 130 may be joined to each other (e.g., edges of knitted component 130 being joined together) following the knitting process, knitted component 130 remains formed of unitary knit construction because it is formed as a one-piece knit element. Additionally, knitted component 130 remains formed of unitary knit construction when other elements (e.g., stabilizers, stretch-limiting elements, straps, aesthetic features, logos, trademarks, and placards are added following the knitting process.

Although the configuration of knitted component 130 may vary considerably, knitted component 130 is depicted as including a collar portion 131, a throat portion 132, and a heel portion 133. Collar portion 131 has a cylindrical configuration that forms collar 122 and defines ankle opening 123 when incorporated into footwear 100. Throat portion 132 extends outward from collar portion 131 and extends through at least a portion of a length of throat area 124 when incorporated into footwear 100. Heel portion 133 also extends outward from collar portion 131 and through at least a portion of a height (e.g., a majority of the height) of heel region 103 when incorporated into footwear 100. In some configurations of footwear 100, heel portion 133 may be absent from knitted component 130.

Although knitted component 130 may be formed from a single layer of textile material, knitted component 130 is depicted as including (a) a first or exterior knit layer 134 and (b) a second or interior knit layer 135 that contact and lay against each other. Each of knit layers 134 and 135 extend through and form opposite surfaces of collar portion 131, throat portion 132, and heel portion 133. That is, each of portions 131-133 are formed from both of knit layers 134 and 135. Referring to the cross-sectional views of FIGS. 4A-4C, exterior knit layer 134 forms a portion of exterior surface 125 and interior knit layer 135 forms a portion of interior surface 126. Stated another way, exterior knit layer 134 forms a first area of exterior surface 125 and cover component 140 forms a second area of exterior surface 125, and interior knit layer 135 forms a first area of interior surface 126 and cover component 140 forms a second area of interior surface 126.

Exterior knit layer 134 and interior knit layer 135 are formed during the knitting process and may also be joined to each other through the knitting process, thereby being formed of unitary knit construction. Although the specific locations in which knit layers 134 and 135 are joined may vary, edges or peripheral areas of knit layers 134 and 135 are depicted as being joined to each other, whereas central areas of knit layers 134 and 135 are depicted as being unjoined to each other. In effect, therefore, knit layers 134 and 135 are separate layers of knitted material, but may be joined at their peripheries. When joined, knit layers 134 and 135 may be joined during the knitting process or following the knitting process. In addition to aesthetic aspects, an advantage of joining knit layers 134 and 135 relates to retaining the relative positions of knit layers 134 and 135 following the knitting process and during the process of incorporating knitted component into upper 120. In other configurations of knitted component 130, however, the peripheral areas of knit layers 134 and 135 may be unjoined or both the peripheral and central areas may be joined.

Although knitted component 130 is formed of unitary knit construction and may be substantially seamless, knitted component 130 may include a seam 136 that joins areas of interior knit layer 135 in collar portion 131. During the knitting process for knitted component 130, which is discussed in greater detail below, a first section of interior knit layer 135 is initially formed, then the exterior knit layer 134 is formed, and finally a second section of interior knit layer 135 is formed, all as a one-piece element. Once the knitting process is effectively complete, the two sections of interior knit layer 135 are joined at seam 136. The joining of interior knit layer 135 at seam 136 may be performed as at a final stage of the knitting process, or following the knitting process. In further configurations, seam 136 may be located in throat portion 132 or heel portion 133, or seam 136 may be located in exterior knit layer 134. Accordingly, in configurations of knitted component 130 that include seam 136, the location of seam 136 may be positioned in various areas of knitted component 130.

Knitted component 130 may be formed from a single type of yarn that imparts common properties to each of portions 131-133 and knit layers 134 and 135. In order to vary the properties of knitted component 130, however, different yarns may be utilized in different areas of knitted component 130. That is, portions 131-133 and knit layers 134 and 135 or different areas of portions 131-133 and knit layers 134 and 135 may be formed from different yarns to vary the properties between areas of knitted component 130. Moreover, one area of knitted component 130 may be formed from a first type of yarn or combination of yarns that imparts a first set of properties, and another area of knitted component 130 may be formed from a second type of yarn or combination of yarns that imparts a second set of properties. Properties may vary throughout knitted component 130, therefore, by selecting specific yarns for different areas of knitted component 130. Examples of properties that may be varied through choice of yarn include color, pattern, luster, stretch, recovery, loft, hand, moisture absorption, biodegradability, abrasion-resistance, durability, and thermal conductivity. It should also be noted that two or more yarns may be utilized in combination to take advantage of properties from both yarns, such as when yarns are plated or form different courses in the same area.

The properties that a particular type of yarn will impart to an area of knitted component 130 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is durable, abrasion-resistant, and has relatively high strength. Polyester is a hydrophobic material that also provides relatively high durability. Yarns that incorporate thermoplastic materials may also permit areas of knitted component 130 to be fused or stabilized through the application of heat. In addition to materials, other aspects of the yarns selected for knitted component 130 may affect properties. For example, a yarn forming knitted component 130 may be a monofilament yarn or a multifilament yarn. The yarn may also include separate filaments that are each formed of different materials. In addition, the yarn may include filaments that are each formed of two or more different materials, such as a bi-component yarn with filaments having a sheath-core configuration or two halves formed of different materials. Different degrees of twist and crimping, as well as different deniers, may also affect the properties of knitted component 130. Accordingly, both the materials forming the yarn and other aspects of the yarn may be selected to impart a variety of properties to separate areas of knitted component 130.

In addition to the type of yarn that is selected for knitted component 130, the knit structure in knitted component 130 imparts particular properties. As depicted, a majority of knitted component 130 is formed to have a common or single knit structure, which is relatively untextured and may be referred to as a tubular or plain knit. In further configurations, however, knitted component 130 may have a rib knit structure or mesh knit structure, or knitted component 130 may have a hybrid knit structure in which multiple types of knit structures are utilized in one area. In order to vary the properties of knitted component 130, different knit structures may be utilized in different areas of knitted component 130. That is, portions 131-133 and knit layers 134 and 135 or different areas of portions 131-133 and knit layers 134 and 135 may be formed from different knit structures to vary the properties between areas of knitted component 130. Moreover, one area of knitted component 130 may be formed from a first knit structure or combination of knit structures that imparts a first set of properties, and another area of knitted component 130 may be formed from a second knit structure or combination of knit structures that imparts a second set of properties. Properties may vary throughout knitted component 130, therefore, by selecting specific knit structures for different areas of knitted component 130. Examples of properties that may be varied through choice of yarn include pattern, luster, stretch, recovery, loft, hand, moisture absorption, abrasion-resistance, durability, and thermal conductivity.

Properties may be further varied by selecting both the type of yarn and the knit structure that is utilized in knitted component 130 or areas of knitted component 130. By combining various types of yarn with various knit structures, further combinations of properties may be imparted to knitted component 130. For example, a first type of yarn and a first knit structure may be utilized in one area of knitted component 130 to provide a set of properties, and a second type of yarn and a second knit structure may be utilized in a different area of knitted component 130 to provide a different set of properties. As more specific examples: (a) collar portion 131 may incorporate types of yarn and knit structures that impart high stretch, and throat portion 132 may incorporate types of yarn and knit structures that impart low stretch or (b) exterior knit layer 134 may be formed from types of yarn and knit structures that are durable and impart a particular aesthetic, and interior knit layer 135 may be formed from types of yarn and knit structures that are comfortable and wick moisture away from the wearer. Accordingly, selecting particular combinations of types of yarn and knit structures for each area of knitted component 130 permits each area to have a particular combination of beneficial properties.

Based upon the above discussion, a portion of upper 120 incorporates knitted component 130, which is formed of unitary knit construction. Knitted component 130 may form collar 122 and extend into throat area 124. Knitted component 130 may also extend downward and into heel region 103. Although knitted component may be formed from a single knit layer, knitted component 130 may also have two or more knit layers.

Further Configurations

Figure 12A:
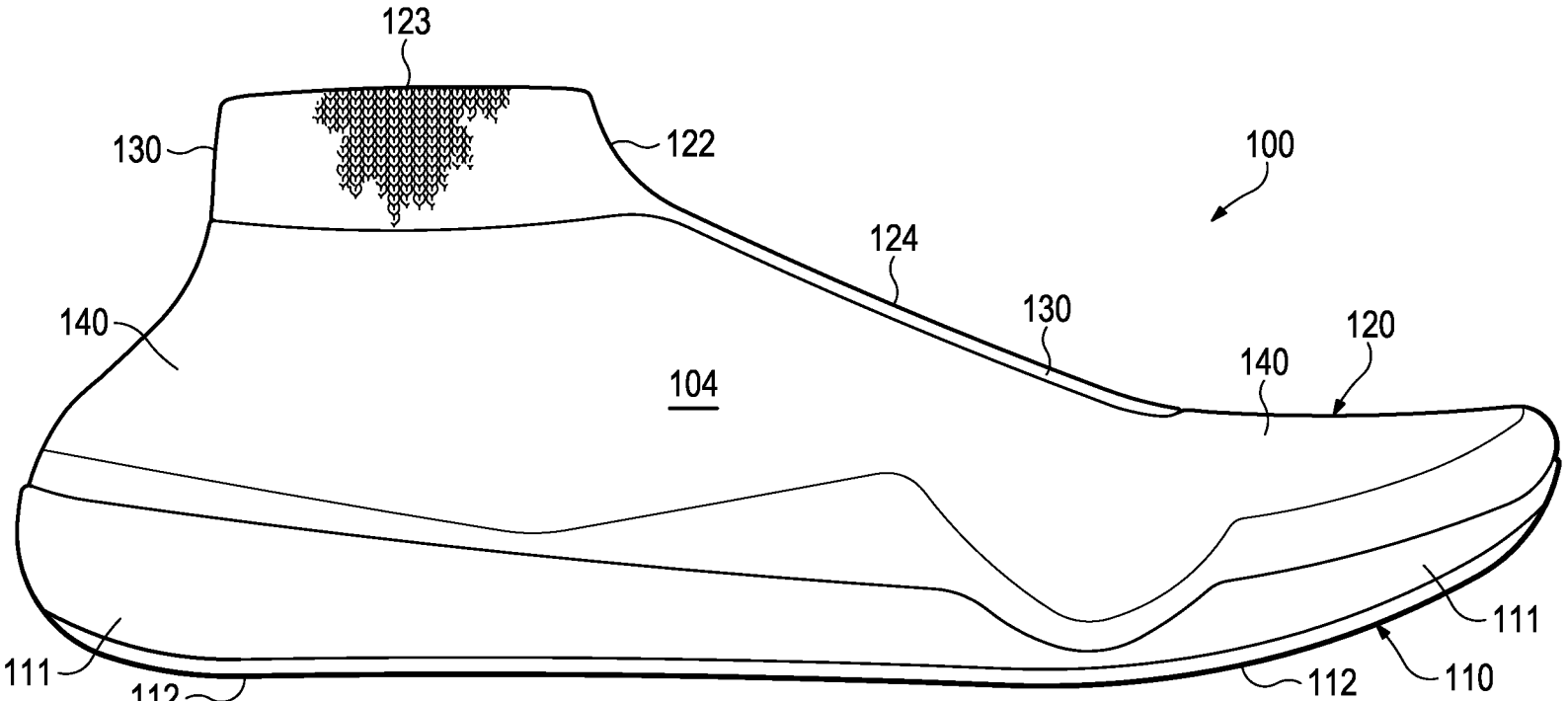
FIGS. 12A-12E are lateral side elevational views corresponding with FIG. 1 and depicting further configurations of the article of footwear.
Figure 12B:
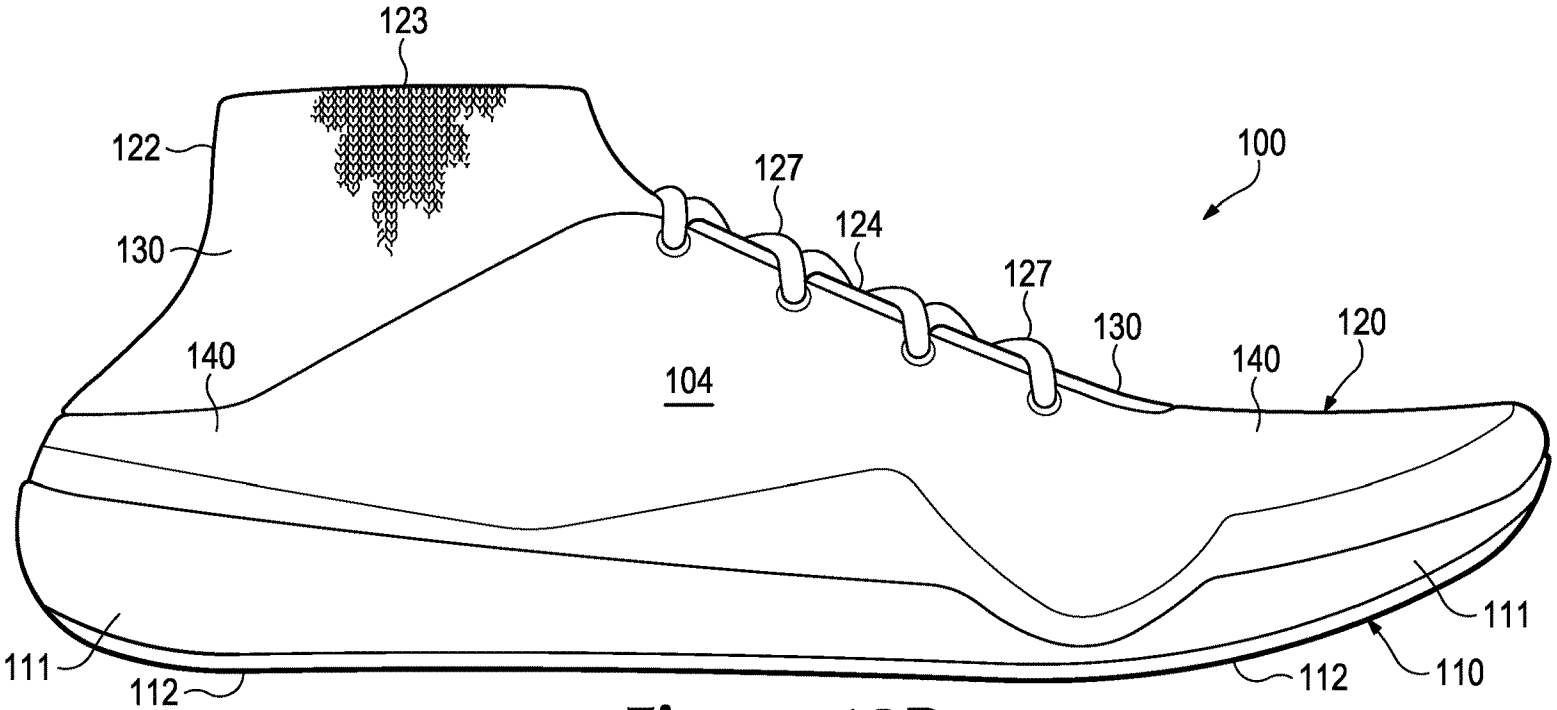
Figure 12C:
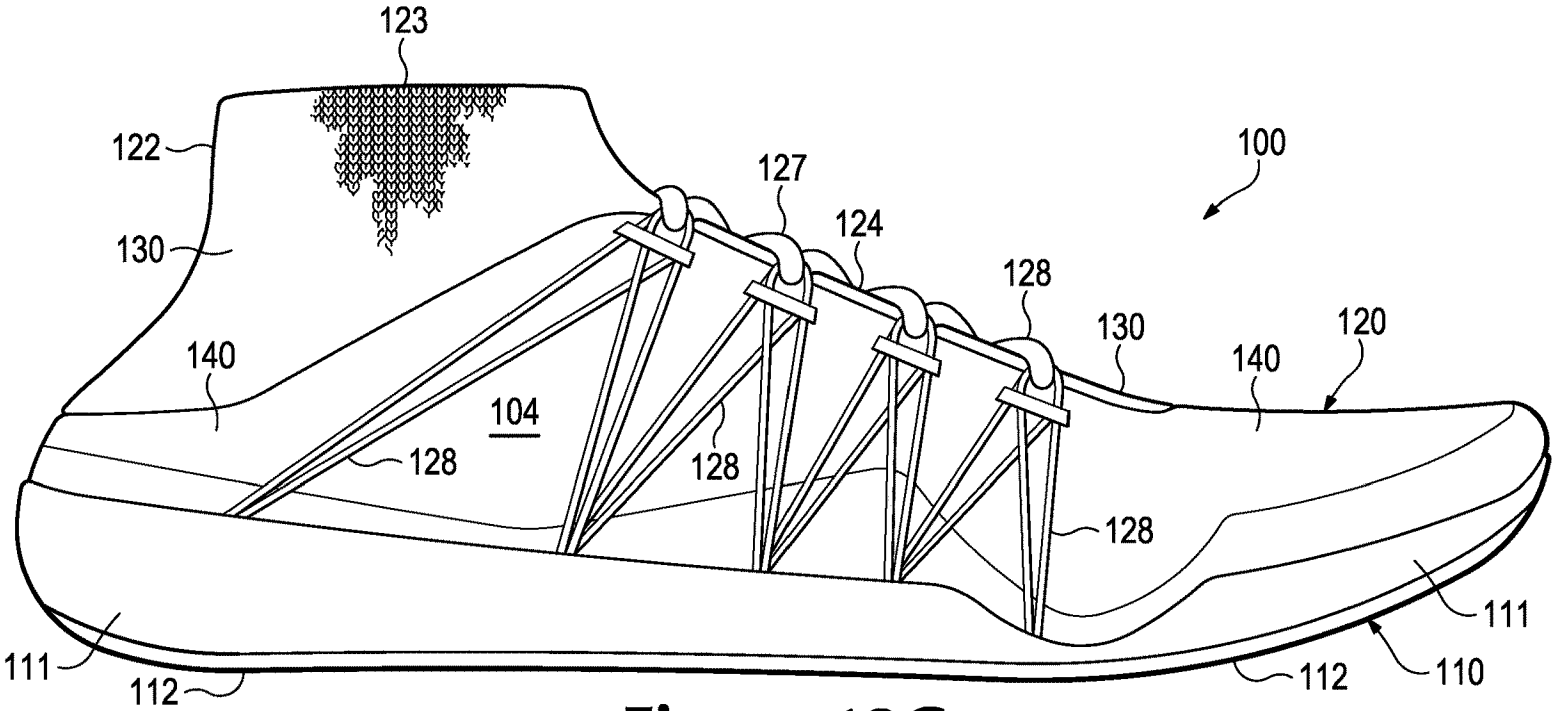

The configuration of footwear 100 and knitted component 130 discussed above and depicted in the figures provides one example relating to the structure of footwear 100 and knitted component 130. In further configurations, numerous features of footwear 100 and knitted component 130 may vary considerably. Referring to FIG. 12A, for example, cover component 140 extends further upward in heel region 103, such that heel portion 133 is either absent or located within cover component 140. In another configuration depicted in FIG. 12B, footwear 100 includes a lace 127 to assist with further tightening of upper 120 around the foot. Lace 127 passes through various apertures in upper 120, extends across throat area 124, and contacts the portion of exterior surface 125 formed by throat portion 132. Alternatives to the apertures in upper 120 include D-rings, hooks, and other lace-receiving elements, including the various looped strands 128 depicted in FIG. 12C. Looped strands 128 extend upward from a lower area of upper 120 and form a plurality of loops, through which lace 127 extends. Further information regarding structures similar to looped strands 128 may be found in U.S. patent application Ser. No. 13/529,381, which was filed in the U.S. Patent and Trademark Office on 21 Jun. 2012 and is entitled Footwear Incorporating Looped Tensile Strand Elements, such application being entirely incorporated herein by reference.

Figure 12D:
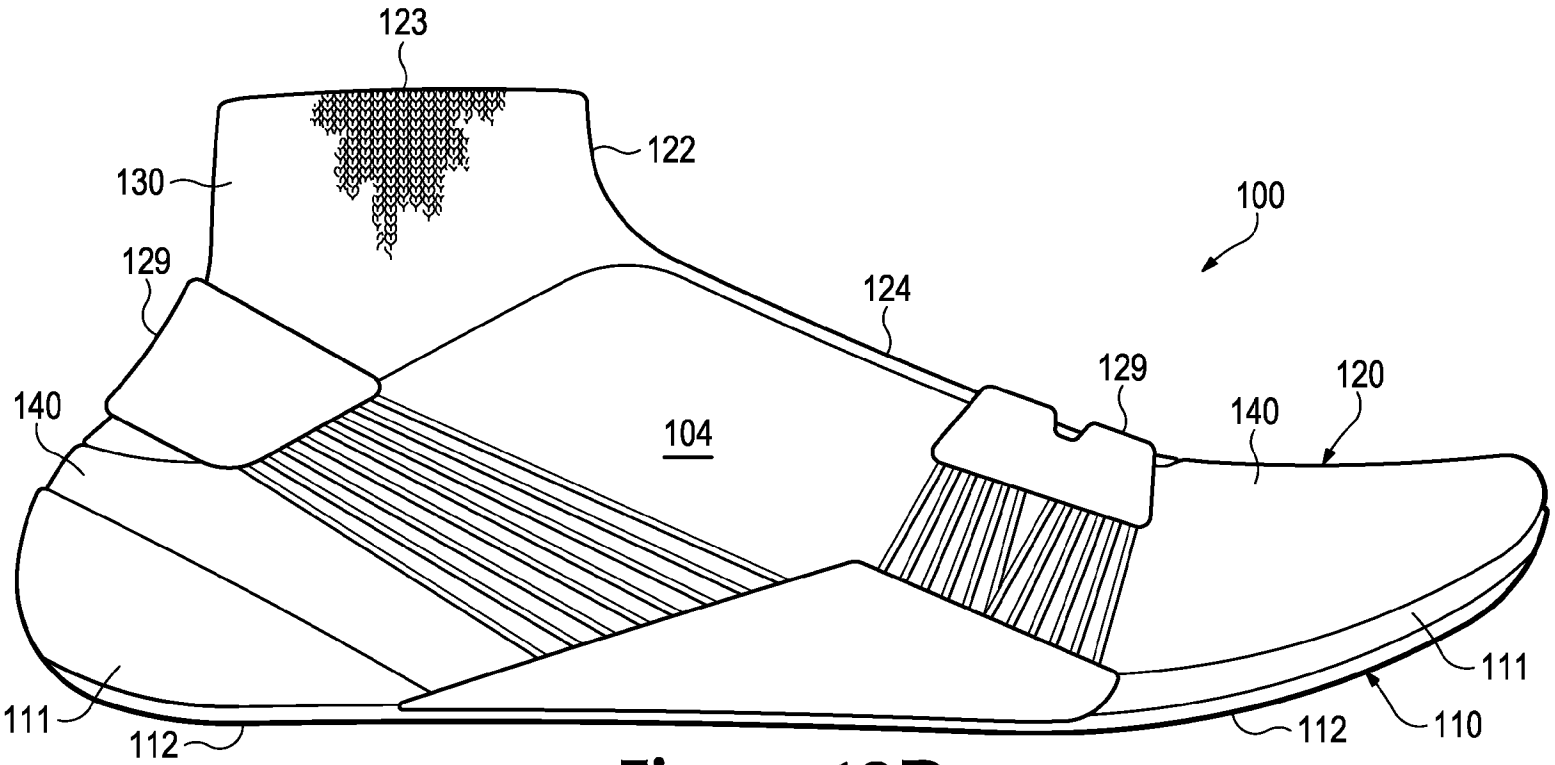
Figure 12E:
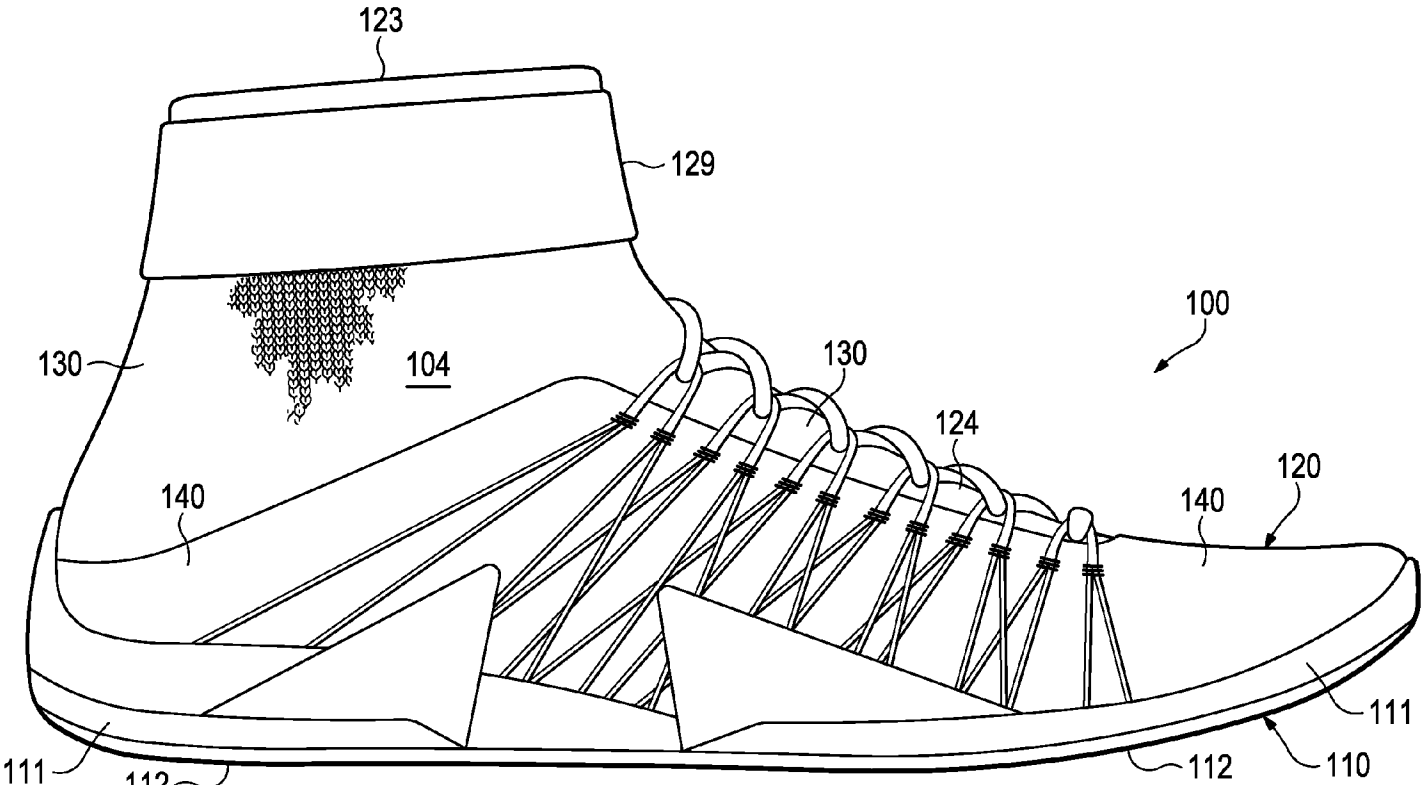

A further variation of footwear 100 is depicted in FIG. 12D as having a configuration that includes a pair of support straps 129 extending outward or upward from the lower area of upper 120. One support strap 129 extends over throat area 124 at the interface between forefoot region 101 and midfoot region 102, and the other support strap 129 extends around heel region 103. When walking or running, support straps 129 may provide additional stability and ensure that footwear 100 remains properly positioned on the foot. Referring to FIG. 12E, another example of a support strap 129 extends around collar 122 (i.e., collar portion 131) to provide additional support for the ankle. Moreover, lace 127 and looped strands 128 are also incorporated into this configuration to assist with further tightening of upper 120 around the foot.

Figure 13A:
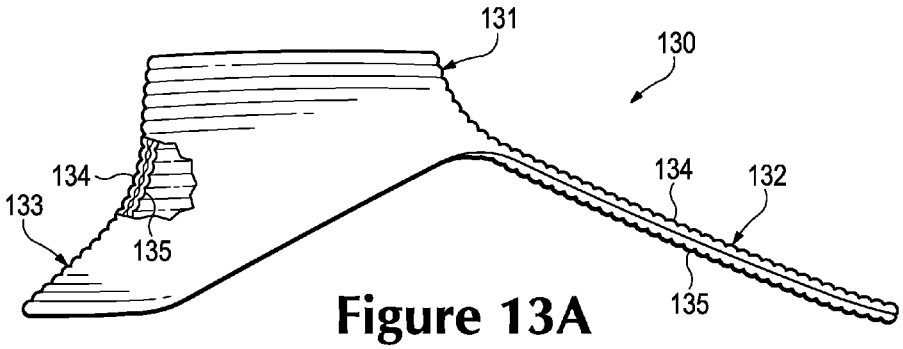
FIGS. 13A-13E are lateral side elevational views corresponding with FIG. 7 and depicting further configurations of the knitted component.
Figure 13B:
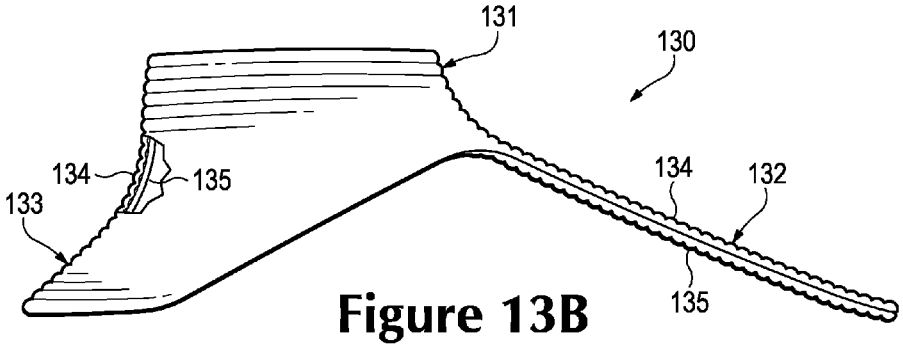
Figure 13C:
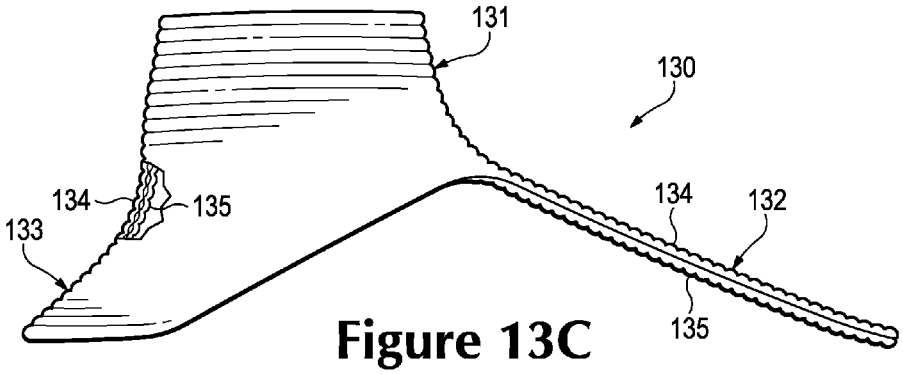
Figure 13D:
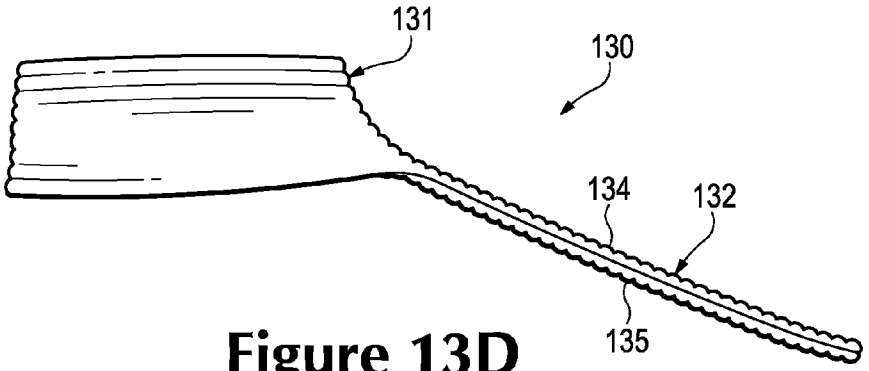
Figure 13E:
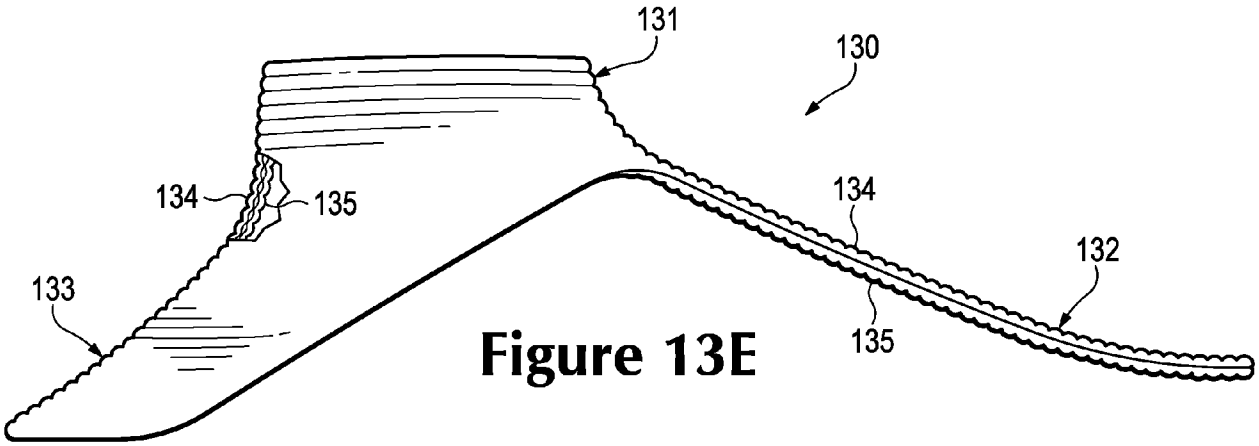

In addition to variations in other areas of footwear 100, numerous features of knitted component 130 may vary considerably. Referring to FIG. 13A, knitted component 130 includes a rib knit structure. More particularly, both of knit layers 134 and 135 are formed to have the rib knit structure. As a variation upon this, FIG. 13B depicts exterior knit layer 134 as including a rib knit structure, whereas interior knit layer 135 has a plain knit structure. Although not depicted, another configuration may utilize a rib knit structure for exterior knit layer 134, and interior knit layer 135 may include one area with the rib knit structure and another area with the plain knit structure or a mesh knit structure. Further variations in knitted component 130 may relate to the relative sizes of portions 131-133. For example, FIG. 13C depicts a configuration where collar portion 131 extends upward to a greater degree and would cover more of an ankle of the wearer. In FIG. 13D, heel portion 113 is absent from knitted component 130, which may result in the configuration discussed previously for FIG. 12A. Additionally, FIG. 13E depicts a configuration wherein each of throat portion 132 and heel portion 133 have an increased length.

Figure 14A:
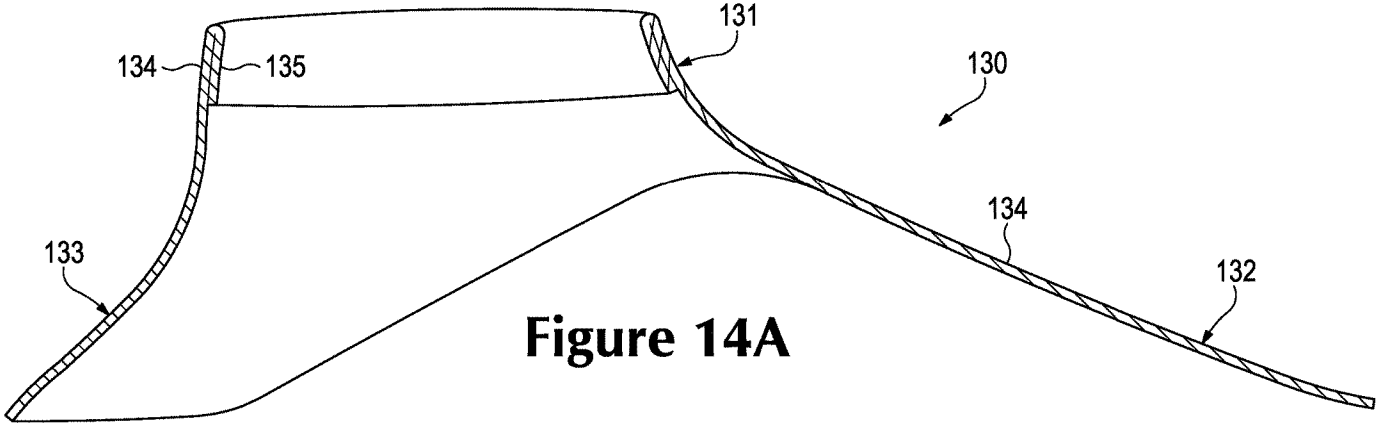
FIGS. 14A-14F are cross-sectional views corresponding with FIG. 11E and depicting further configurations of the knitted component.
Figure 14B:
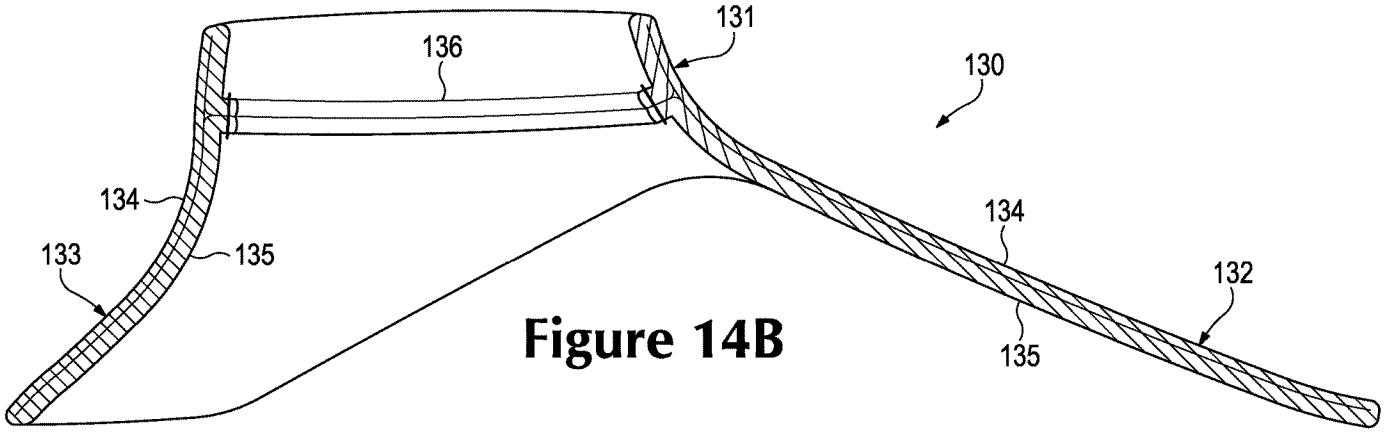
Figure 14C:
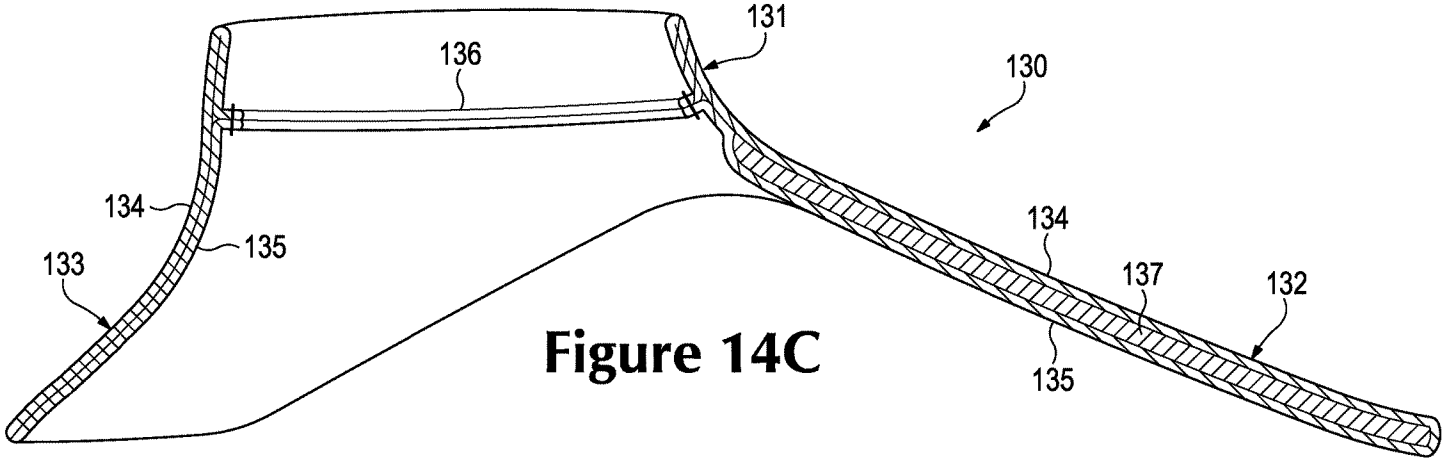
Figure 14D:
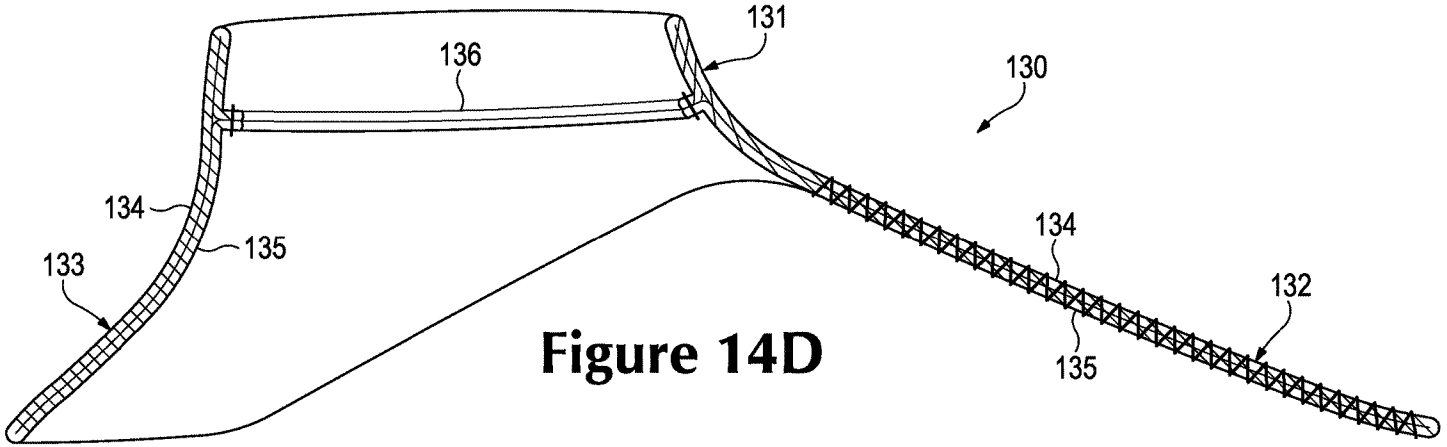
Figure 14E:
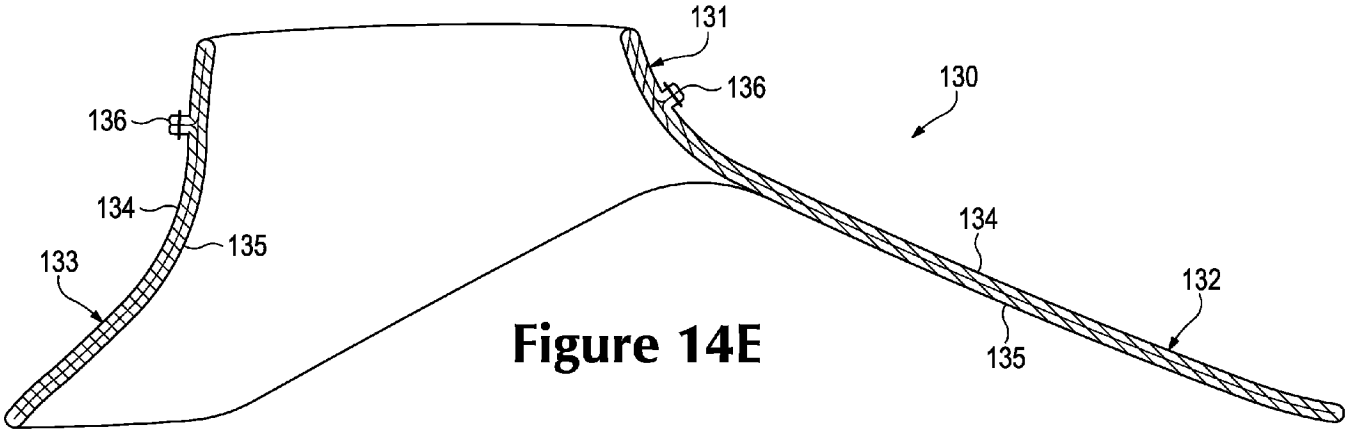
Figure 14F:
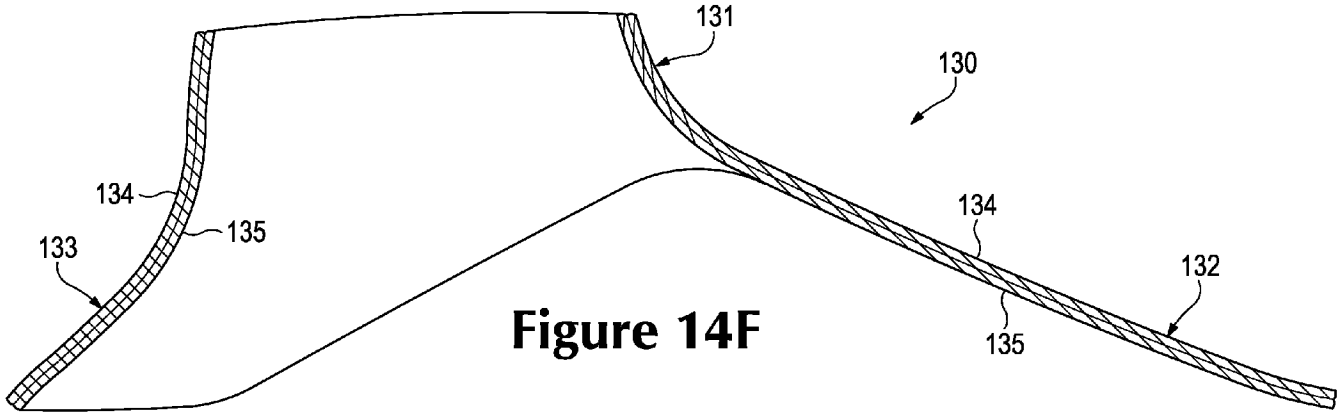

A further variation of knitted component 130 is depicted in FIG. 14A, in which some of collar portion 131 includes both of knit layers 134 and 135, but throat portion 132 and heel portion 133 only include exterior knit layer 134. Knitted component 130 may have various features that provide additional padding in throat area 124, which may enhance comfort in configurations that include lace 127. For example, FIG. 14B depicts interior knit layer 135 as having increased thickness, and FIG. 14C depicts a foam element 137 that is located between knit layers 134 and 135 in throat portion 132. As a further variation, FIG. 14D depicts stitching as joining knit layers 134 and 135 in throat portion 132. Referring to FIG. 14E, seam 136 joins portions of exterior knit layer 134, rather than exterior layer 135, in collar portion 131. Although knit layers 134 and 135 may be formed of unitary knit construction, FIG. 14F depicts a configuration wherein knit layers 134 and 135 are formed as separate elements that lay against each other.

First Example Manufacturing Process

Although a knitting process that forms knitted component 130 may be performed by hand, the commercial manufacture of multiple knitted components 130 will generally be performed by knitting machines. In general, knitting involves forming courses and wales of intermeshed loops of a yarn or multiple yarns. In production, knitting machines may be programmed to mechanically-manipulate one or more yarns into the configuration of knitted component 130. That is, knitted component 130 may be formed by mechanically-manipulating one or more yarns to form a one-piece textile element that has the shape and features of knitted component 130. As such, knitted component may be formed of unitary knit construction utilizing a knitting machine.

Although knitted component 130 may be formed through a variety of different knitting processes and using a variety of different knitting machines, circular knitting (i.e., the use of a circular knitting machine) has the capability of forming knitted component 130 to have the various features discussed above. In general, circular knitting involves forming a plurality of courses and wales. As an example, courses are circular rows of loops that extend entirely around collar portion 131 and across the widths of throat portion 132 and heel portion 133. Wales are columns of loops that extend perpendicular to the courses and from collar portion 131 to each of throat portion 132 and heel portion 133. That is, the courses in knitted component 130 may extend from collar portion 131 to either of throat portion 132 and heel portion 133. Although general or conventional circular knitting processes may be utilized to form knitted component 130, specific examples of knitting processes that may be utilized include wide tube circular knitting, narrow tube circular knitting, narrow tube circular knit jacquard, single knit circular knit jacquard, double knit circular knit jacquard, warp knit jacquard, and flat knitting, for example.

Manufacturing knitted component 130 through circular knitting provides advantages of simplicity and efficient manner. Other advantages or combinations of advantages may, however, be gained through utilizing another of the various knitting processes mentioned above. For example, flat knitting may be utilized to form knitted component 130 with different stretch and recovery properties, apertures within the knit structure that enhance breathability, and various levels of durability. Accordingly, different advantages or features may be gained through selection of the knitting process utilized to form knitted component 130.

Figure 15:
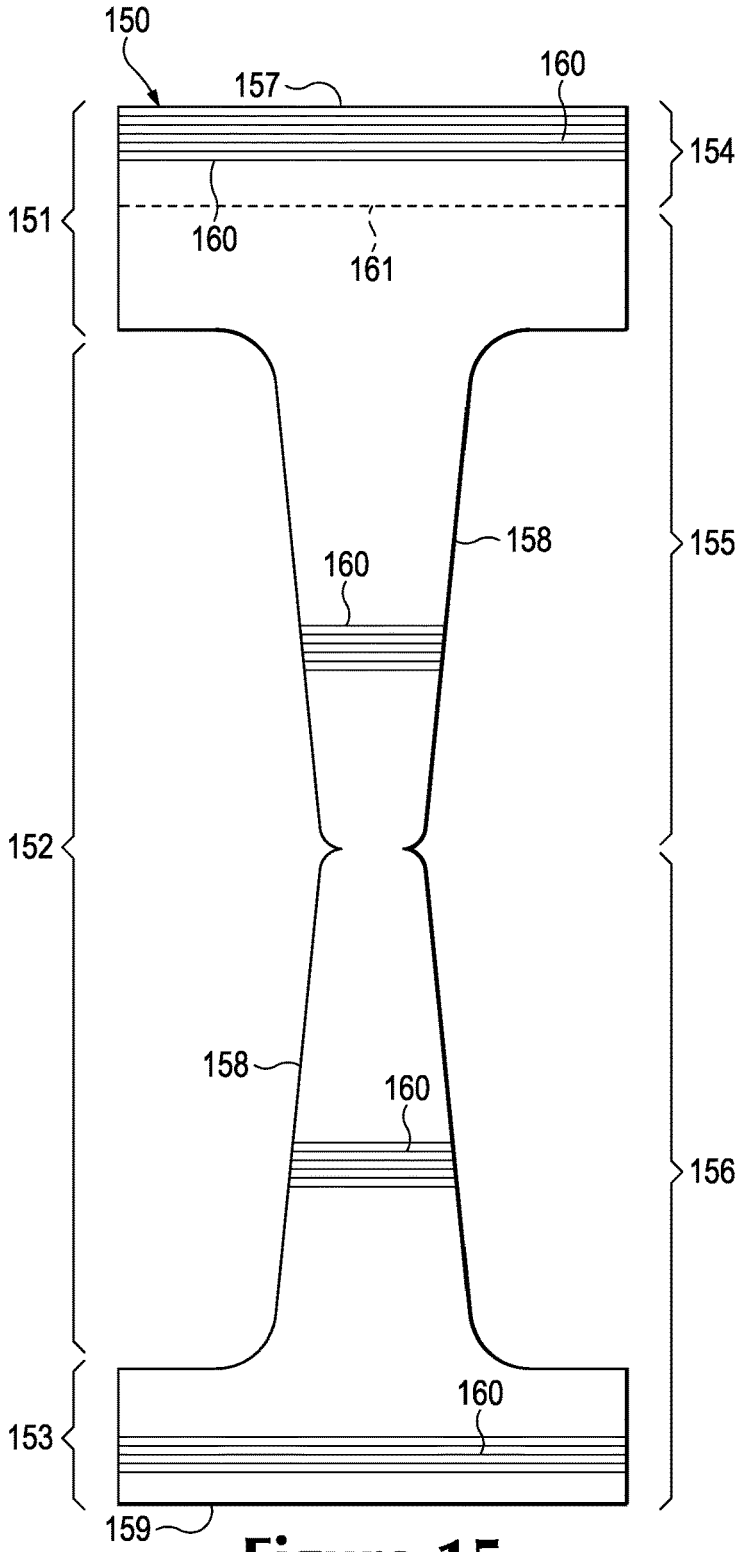
FIG. 15 is a schematic view of a pattern for forming the knitted component.

The knitting process for forming knitted component 130 will now be discussed in greater detail. For purposes of simplicity and clarity, the configuration of FIG. 13D, in which heel portion 133 is absent, will be utilized to illustrate features of the knitting process. One skilled in the art will recognize that other features of knitted component 130, including heel portion 133, may be formed by merely modifying aspects of knitting process discussed below. Referring to FIG. 15, a pattern 150 for forming knitted component 130 is illustrated. Pattern 150 includes a first collar section 151, a throat section 152, and a second collar section 153. Whereas collar sections 151 and 153 represent areas of pattern 150 that form collar portion 131 in knitted component 130, throat section 152 represents an area of pattern 150 that forms throat portion 132. In tandem with sections 151-153, pattern 150 also includes a first interior layer section 154, an exterior layer section 155, and a second interior layer section 156. Whereas interior layer sections 154 and 156 represent areas of pattern 150 that form interior knit layer 135 in knitted component 130, exterior layer section 155 represents an area of pattern 150 that forms exterior knit layer 135. Due to overlap between areas of sections 151-156, sections 151-153 are identified on one side of pattern 150 and sections 154-156 are identified on an opposite side of pattern 150. Although pattern 150 provides a suitable pattern for forming knitted component 130 through a circular knitting process, other patterns may also be utilized.

In addition to sections 151-156, pattern 150 also includes various additional features, including a first seam edge 157, a pair of side edges 158, a second seam edge 159, and a plurality of courses 160. As discussed in greater detail below, seam edges 157 and 159 represent portions of pattern 150 located and joined at seam 136. Side edges 158 are primarily located in throat section 152 and represent the edges or peripheral areas of knit layers 134 and 135 that are joined to each other in throat section 152. Additionally, courses 160 represent the various courses in knitted component 130, which are rows of loops that extend entirely around collar portion 131 (i.e., circular courses) and across the widths of throat portion 132 (i.e., non-circular or linear courses). For purposes of reference, a dashed line 161 extends across first collar section 151 at the interface between sections 154 and 155 and represents the position of ankle opening 123.

Pattern 150 is a graphical representation of data that is processed by a circular knitting machine to form knitted component 130. In forming knitted component 130, the knitting machine reads data associated with each course 160, starting at first seam edge 157 and continuing successively downward to second seam edge 159. Initially, therefore, the knitting machine reads data associated with the course 160 located at first seam edge 157 and forms a circular course based upon that data. In addition to identifying the particular knit structures that are formed, the data also identifies the particular yarns that form the knit structures. Once this data is processed, the knitting machine mechanically-manipulates the yarns to form a first course of knitted component 130. For purposes of reference, pattern 150 identifies the first course 160 (i.e., the course 160 located at first seam edge 157) as being in first collar section 151 and first interior layer section 154. As a result, the first course formed by the knitting machine will form a portion of knitted component 130 located in collar portion 131 and interior knit layer 135, and the first course may be held on a dial of the knitting machine. At this point, the knitting machine continues knitting circular courses, each of which are located in collar portion 131 and interior knit layer 135.

After knitting a defined number of courses, the knitting machine reads data from pattern 150 associated with courses 160 that are in first collar section 151 and exterior layer section 155. As such, the knitting machine has transitioned to forming circular courses of knitted component 150 located in collar portion 131 and exterior knit layer 134.

As the knitting process continues, the knitting machine reads data from pattern 150 associated with courses 160 that are in throat section 152 and exterior layer section 155. As such, the knitting machine has transitioned to forming courses of knitted component 150 located in throat portion 132 and exterior knit layer 134. Whereas prior courses were circular, these courses are non-circular or linear and only extend between the edges or peripheral areas of throat portion 132.

Once the knitting process completes forming the areas of knitted component 130 located in throat portion 132 and exterior knit layer 134, the knitting machine reads data from pattern 150 associated with courses 160 that are in throat section 152 and second interior layer section 156. As such, the knitting machine has transitioned to forming courses of knitted component 130 located in throat portion 132 and interior knit layer 135. These courses are also non-circular or linear and only extend between the edges or peripheral areas of throat portion 132. As the knitting machine forms these courses, the knitting machine also joins the edges of knit layers 134 and 135 in throat portion 132.

As the knitting process continues, the knitting machine reads data from pattern 150 associated with courses 160 that are in second collar section 153 and second interior layer section 156. As such, the knitting machine has transitioned to forming circular courses of knitted component 150 located in collar portion 131 and interior layer 135. As the knitting process continues further, the knitting machine mechanically-manipulates the yarns to form a final course of knitted component 130. For purposes of reference, pattern 150 identifies the final course 160 (i.e., the course 160 located at second seam edge 159) as being in second collar section 153 and second interior layer section 156. When forming the final course of knitted component 130, the first course may be joined to the final course, thereby forming seam 136. That is, the first course, which was held on the dial throughout the knitting process, may be joined to the final course to form seam 136. In some configurations, seam 136 may be formed by hand or through a stitching process, or a flat seam or flat stitch may extend over the seam 136 stitch to provide a more finished appearance.

Many aspects of the knitting process discussed above may be performed using a conventional circular knitting machine. In order to facilitate some portions of the knitting process, however, the circular knitting machine may be modified to raise and lower the dial, which holds the first course formed in knitted component 130. Additionally, a blower may be utilized to ensure that knitted component 130 remains properly located within the circular knitting machine during the knitting process.

Based upon the discussion above, the circular knitting process forms knitted component 130 by (a) forming knit layers 134 and 135 to be substantially coextensive layers and (b) joining peripheral areas of knit layers 134 and 135 to each other, particularly in throat portion 132. Once the knitting process is complete, knitted component 130 is incorporated into upper 120 such that knitted component 130 forms collar 122 and extends through a portion of, possibly a majority of, a length of throat area 124. Either stitching, adhesive bonding, or thermal bonding may be used to join knitted component 130 with cover component 140.

Second Example Manufacturing Process

Figure 16:
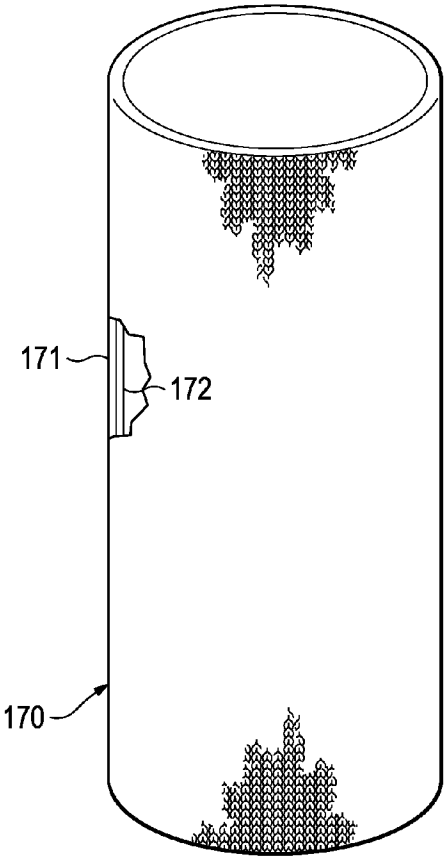
FIG. 16 is a perspective view of a tubular structure.

Another example of a manufacturing process that may be utilized to form knitted component 130 will now be discussed. In manufacturing knitted component 130, a circular knitting process is utilized to form a tubular structure 170, as depicted in FIG. 16. Tubular structure 170 has a generally cylindrical configuration and includes an exterior knit layer 171 and an interior knit layer 172. Each of knit layers 171 and 172 also have the generally cylindrical configuration and extend throughout the height of tubular structure 170 and entirely around the circumference of tubular structure 170. Whereas exterior knit layer 171 forms an outer surface of tubular structure 170, interior knit layer 172 forms an inner surface of tubular structure 170.

Figure 17:
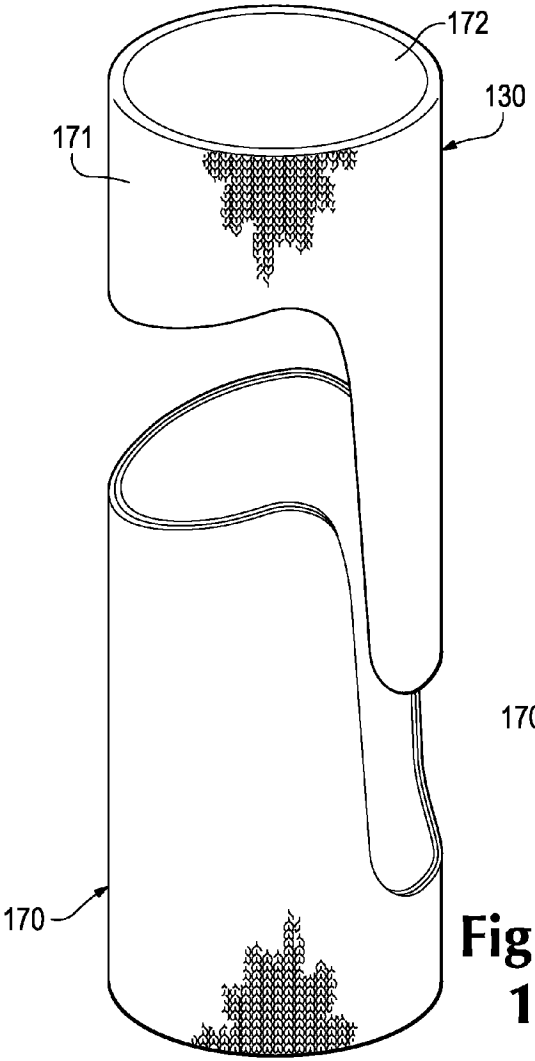
FIG. 17 is a perspective view of the knitted component when removed from the tubular structure.

In order to form knitted component 130, tubular structure 170 is cut into two separate portions, as depicted in FIG. 17, with one of the portions being knitted component 130. That is, knitted component 130 may be cut or otherwise separated or removed from tubular structure 170. When formed through this process, some edges of knitted component 130 may not have a finished configuration and may include yarn ends. In order to prevent unraveling of these edges, stitching or bonding may be utilized. Moreover, knitted component 130 may include a fusible or thermoplastic yarn that melts upon the application of heat to prevent unraveling. Although only a single knitted component 130 is depicted as being removed from tubular structure 170, a second knitted component 130 may be removed from the lower portion of tubular structure 170 and incorporated into a separate article of footwear. Multiple knitted components 130 may, therefore, be formed from a single tubular structure 170.

Figure 18:
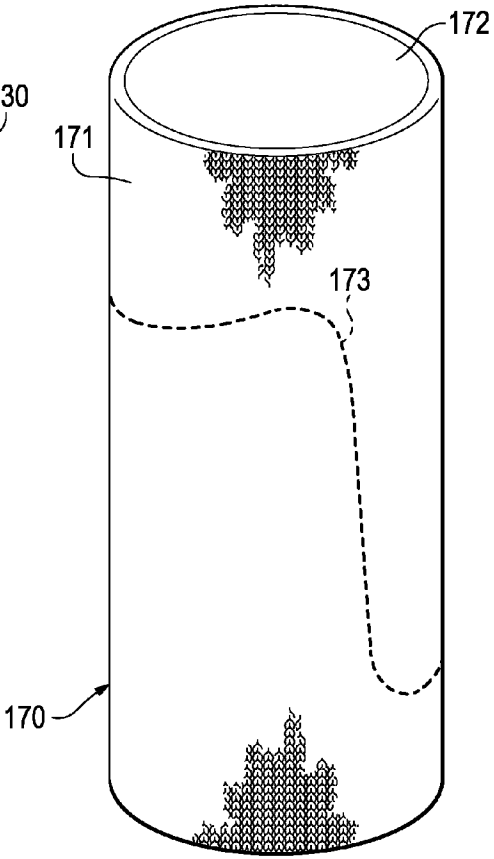
FIG. 18 is a perspective view of another configuration of the tubular structure.

Another configuration of tubular structure 170 is depicted in FIG. 18 as including a cut line 173, which may be a visual guide that assists with accurately removing knitted component 130 from tubular structure 170. As examples, cut line 173 may be an area of tubular structure 170 that has a different type of stitch or different color of yarn. Cut line 173 may also be an area of tubular structure 170 that is formed from a soluble or meltable yarn that dissolves or softens in the presence of a solvent (e.g., water) or heat to assist with removing knitted component 130 from tubular structure 170. Although only a single cut line 173 for separating a single knitted component 130 is depicted in FIG. 18, a second cut line 173 for separating a second knitted component 130 from tubular structure 170 may also be present.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, the upper comprising:

a knitted component including a collar portion and a throat portion, wherein the collar portion and the throat portion comprise a one-piece structure, and wherein the collar portion comprises a continuous tubular structure, and the throat portion extends outward from the collar portion and through at least a portion of a length of a throat area of the upper, the collar portion and the throat portion forming (a) a first area of an exterior surface of the upper and (b) a first area of an interior surface of the upper, wherein the knitted component comprises a bottom peripheral edge; and a cover component extending between the knitted component and the sole structure, the cover component having an outer surface forming a second area of the exterior surface of the upper and an inner surface forming a second area of an inner-most interior surface of the upper defining a void for receiving a foot, wherein the cover component comprises an upper peripheral edge and wherein the upper peripheral edge of the cover component is secured to the bottom peripheral edge of the knitted component;

wherein the knitted component includes a first knit layer and a second knit layer, the first knit layer and second knit layer being at least partially coextensive, the first knit layer forming the first area of the exterior surface of the upper, and the second knit layer forming the first area of the interior surface of the upper, each of the first knit layer and the second knit layer extending from the collar portion and through at least a portion of a length of the throat portion, and wherein the knitted component further includes a heel portion extending outward from the collar portion and through at least a portion of a height of a heel region of the article of footwear, each of the first knit layer and the second knit layer extending from the collar portion through the portion of the height of the heel region to the cover component.

2. The article of footwear of claim 1, wherein the first knit layer contacts and lays against the second knit layer.

3. The article of footwear of claim 1, wherein (a) peripheral areas of the first knit layer and the second knit layer are joined to each other and (b) central areas of the first knit layer and the second knit layer are unjoined to each other.

4. The article of footwear of claim 1, wherein the knitted component includes separate regions having at least one of (a) different knit structures and (b) different yarns.

5. The article of footwear of claim 1, wherein at least a portion of the knitted component has a rib knit structure.

6. The article of footwear of claim 1, wherein a lace extends across the throat area and contacts the first area of the exterior surface of the upper.

7. The article of footwear of claim 1, wherein the upper includes (a) a plurality of tensile strands extending through a region between the knitted component and the sole structure and (b) a lace coupled to the tensile strands and extending across the throat area.

8. An article of footwear having an upper and a sole structure secured to the upper, the upper comprising:

a textile component comprising a one-piece knit structure including an outer knit layer and an inner knit layer laying adjacent to each other, each of the outer knit layer and the inner knit layer forming a collar of the upper, wherein the collar comprises a continuous tubular structure; and wherein each of the outer knit layer and the inner knit layer are at least partially coextensive with each other and extend continuously from the collar and through at least a portion of a length of a throat area of the upper, the outer knit layer forming a first area of an exterior surface of the upper, and the inner knit layer forming a first area of an interior surface of the upper, wherein the textile component comprises a bottom peripheral edge; and a cover component extending between the textile component and the sole structure, the cover component having an outer surface forming a second area of the exterior surface of the upper and an inner surface forming a second area of an inner-most interior surface of the upper defining a void for receiving a foot, and wherein the cover component comprises an upper peripheral edge secured to the bottom peripheral edge of the textile component;

wherein the textile component extends across the throat area between a lateral side and a medial side of the article, and wherein the textile component further includes a heel portion extending outward from the collar portion and through at least a portion of a height of a heel region of the article of footwear, each of the outer knit layer and the inner knit layer extending from the collar portion through the heel region to the cover component.

9. The article of footwear of claim 8, wherein the textile component has a cylindrical configuration in the collar.

10. The article of footwear of claim 8, wherein the outer knit layer contacts and lays against the inner knit layer.

11. The article of footwear of claim 8, wherein (a) peripheral areas of the outer knit layer and the inner knit layer are joined to each other and (b) central areas of the outer knit layer and the inner knit layer are unjoined to each other.

12. The article of footwear of claim 8, wherein each of the outer knit layer and the inner knit layer extend outward from the collar portion and through a majority of the height of a heel region of the article of footwear.

13. The article of footwear of claim 8, wherein the textile component includes a seam where two sections of the inner knit layer are joined to each other.

14. The article of footwear of claim 8, wherein the outer knit layer includes separate regions having at least one of (a) different knit structures and (b) different yarns.

15. The article of footwear of claim 8, wherein a lace extends repeatedly across the throat area and contacts the first knit layer.

16. The article of footwear of claim 8, wherein the upper includes (a) a plurality of tensile strands extending through a region between the textile component and the sole structure and (b) a lace coupled to the tensile strands and extending repeatedly across the throat area.

17. The article of footwear of claim 1, wherein the first knit layer forms a continuous layer across the collar portion and through at least a majority of the throat portion, and the second knit layer forms a continuous layer across the collar portion and through a majority of the throat portion.

18. The article of footwear of claim 8, wherein the outer knit layer is a continuous layer forming the collar and extending through at least a portion of a length of a throat area, and the inner knit layer is a continuous layer forming the collar and extending through at least a portion of a length of a throat area.

19. The article of footwear of claim 1, wherein the cover component is secured to the textile component by one or more of stitching, adhesive bonding, and thermal bonding.

20. An article of footwear having an upper and a sole structure secured to the upper, the upper comprising:

a knitted component including a collar portion and a throat portion, wherein the collar portion comprises a continuous tubular structure and wherein the throat portion extends outwardly from the collar portion and through at least a portion of a length of a throat area of the upper, the collar portion and the throat portion forming (a) a first area of an exterior surface of the upper and (b) a first area of an interior surface of the upper; and a cover component secured to the knitted component and extending between the knitted component and the sole structure, such that the cover component comprises a continuous and uninterrupted boundary that separates a lower peripheral edge of the knitted component by a distance from the sole structure, the cover component having an outer surface forming a second area of the exterior surface of the upper and an inner surface forming a second area of an inner-most interior surface of the upper defining a void for receiving a foot;

wherein the cover component is secured to the knitted component by one or more of stitching, adhesive bonding, and thermal bonding; and wherein the knitted component includes a first knit layer and a second knit layer, the first knit layer forming the first area of the exterior surface of the upper, and the second knit layer forming the first area of the interior surface of the upper, each of the first knit layer and the second knit layer extending from the collar portion and through at least a portion of a length of the throat portion, wherein the knitted component further includes a heel portion extending outward from the collar portion and through at least a portion of a height of a heel region of the article of footwear, each of the first knit layer and the second knit layers extending from the collar portion and through the heel region to the cover component, and wherein each of the first knit layer and second knit layer are contiguous from the heel region through the collar region and into the throat region.

21. The article of footwear of claim 1, wherein each of the first knit layer and second knit layer are contiguous from the heel region through the collar region and into the throat region.

* * * * *